US012408747B2

(12) United States Patent
Nye et al.

(10) Patent No.: US 12,408,747 B2
(45) Date of Patent: Sep. 9, 2025

(54) BLOW-MOLDED PLASTIC STRUCTURES

(71) Applicant: LIFETIME PRODUCTS, INC., Clearfield, UT (US)

(72) Inventors: S. Curtis Nye, Clinton, UT (US); Carl R. Stanford, Clearfield, UT (US); Wendell Peery, Kaysville, UT (US); Eric Olsen, West Haven, UT (US); Charles Monson, Syracuse, UT (US); Frank Clegg, Fruit Heights, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 0 days.

(21) Appl. No.: 15/439,842

(22) Filed: Feb. 22, 2017

(65) Prior Publication Data

US 2017/0238698 A1 Aug. 24, 2017

Related U.S. Application Data

(60) Provisional application No. 62/298,896, filed on Feb. 23, 2016.

(51) Int. Cl.
*A47B 13/08* (2006.01)
*A47B 96/20* (2006.01)
(Continued)

(52) U.S. Cl.
CPC ..... *A47B 13/08* (2013.01); *A47B 96/20* (2013.01); *E04C 2/20* (2013.01); *E04C 2/326* (2013.01);
(Continued)

(58) Field of Classification Search
CPC ..... A47B 13/08–16; A47B 2200/001; E04C 2/20; E04C 2/205; E04C 2/22; E04C 2/30;
(Continued)

(56) References Cited

U.S. PATENT DOCUMENTS 4,280,805 A 7/1981 Hafele
4,379,688 A 4/1983 Tate
(Continued)

FOREIGN PATENT DOCUMENTS

CN 1627908 A 6/2005
CN 102293518 12/2011
(Continued)

OTHER PUBLICATIONS

International Search Report and Written Opinion from PCT/US2017/019046 dated May 16, 2017.
(Continued)

*Primary Examiner* — Megha M Gaitonde
(74) *Attorney, Agent, or Firm* — Maschoff Brennan

(57) ABSTRACT

A large, thin, generally planar panel constructed from blow-molded plastic may include a first surface, a second surface, and a hollow interior portion disposed between the first and second surfaces. The panel may include a nominal panel thickness (PT), which may be the distance between the first surface and the second surface, and a nominal wall thickness (WT), which may be the thickness of the outer wall of the blow-molded plastic structure. A plurality of depressions may be integrally formed in the second surface and a nominal distance (D) separating adjacent depressions may be measured from an edge of one depression to an edge of the adjacent depression. The relationship between the nominal panel thickness, the nominal wall thickness, and the nominal distance between adjacent depressions is shown by the equation $WT \cdot PT \cdot D \leq 0.030$.

25 Claims, 30 Drawing Sheets

(51) Int. Cl.

| | |
|---|---|
| ***E04C 2/20*** | (2006.01) |
| ***E04C 2/32*** | (2006.01) |
| *A47B 3/00* | (2006.01) |
| *A47B 3/087* | (2006.01) |
| *A47B 3/091* | (2006.01) |

(52) U.S. Cl.
CPC ..... *A47B 2003/008* (2013.01); *A47B 3/087* (2013.01); *A47B 3/0912* (2013.01); *A47B 2200/001* (2013.01)

(58) Field of Classification Search
CPC . E04C 2/32; E04C 2/34; E04C 2/3405; E04C 2002/3411–3466; B29C 49/0031; B29C 49/0005; B29C 49/02; Y10T 428/24174; Y10T 428/24182; Y10T 428/24355; Y10T 428/24405; Y10T 428/24479; Y10T 428/24496; Y10T 428/24504; Y10T 428/24537; Y10T 428/24628; Y10T 428/24661; Y10T 428/24669; Y10T 428/24702; Y10T 428/24727
USPC ..... 428/119, 120, 141, 147, 156, 158, 159, 428/163, 166, 167, 174, 178, 179, 183; 264/454
See application file for complete search history.

(56) References Cited

U.S. PATENT DOCUMENTS

| | | | | |
|---|---|---|---|---|
| 4,727,816 | A | 3/1988 | Virtue | |
| 6,912,961 | B2 | 7/2005 | Winter | |
| 6,968,789 | B2 | 11/2005 | Baik | |
| 7,051,662 | B2 | 5/2006 | Shenghao | |
| 7,059,254 | B2 | 6/2006 | Strong | |
| 7,069,865 | B2 * | 7/2006 | Strong | A47B 3/087 108/115 |
| 7,096,799 | B2 | 8/2006 | Strong | |
| 7,111,563 | B2 | 9/2006 | Strong | |
| 7,150,237 | B2 | 12/2006 | Lin | |
| 7,171,910 | B2 | 2/2007 | Neunzert | |
| 7,278,361 | B2 | 10/2007 | Zhurong | |
| 7,331,297 | B2 | 2/2008 | Strong | |
| 7,469,646 | B2 | 12/2008 | Baik | |
| 7,475,642 | B2 | 1/2009 | Shenghao | |
| 7,475,643 | B2 | 1/2009 | Haney | |
| 7,475,644 | B2 | 1/2009 | Strong | |
| 7,640,870 | B2 | 1/2010 | Strong | |
| 7,644,667 | B2 | 1/2010 | Strong | |
| 7,713,603 | B2 | 5/2010 | Farran | |
| D619,831 | S | 7/2010 | Branch | |
| 7,905,185 | B2 | 3/2011 | Peery | |
| D640,487 | S | 6/2011 | Bennett | |
| 7,971,930 | B2 | 7/2011 | Larsen | |
| 8,006,630 | B2 | 8/2011 | Strong | |
| 8,033,228 | B2 | 10/2011 | Haney | |
| 8,156,875 | B2 | 4/2012 | Neunzert | |
| D658,912 | S | 5/2012 | Winter | |
| D659,450 | S | 5/2012 | Winter | |
| 8,166,894 | B1 | 5/2012 | Branch | |
| 8,181,579 | B2 | 5/2012 | Leng | |
| D662,736 | S | 7/2012 | Peery | |
| D662,738 | S | 7/2012 | Winter | |
| D667,659 | S | 9/2012 | Winter | |
| 8,261,676 | B2 | 9/2012 | VanNimwegen | |
| D668,483 | S | 10/2012 | Bennett | |
| 8,302,541 | B2 | 11/2012 | Haney | |
| D671,773 | S | 12/2012 | Johnson | |
| D671,775 | S | 12/2012 | Clegg | |
| D671,776 | S | 12/2012 | Clegg | |
| D672,175 | S | 12/2012 | Peery | |
| 8,342,107 | B2 | 1/2013 | Mower | |
| 8,347,795 | B2 | 1/2013 | Peery | |
| 8,397,652 | B2 | 3/2013 | Peery | |
| 8,397,653 | B2 | 3/2013 | Ashby | |
| 8,408,146 | B2 | 4/2013 | Peery | |
| D681,982 | S | 5/2013 | Clegg | |
| D682,586 | S | 5/2013 | Clegg | |
| D683,985 | S | 6/2013 | Nye | |
| D688,496 | S | 8/2013 | Bennett | |
| 8,534,205 | B1 | 9/2013 | Johnson | |
| 8,544,393 | B2 | 10/2013 | Branch | |
| 8,555,789 | B2 | 10/2013 | Jin | |
| 8,555,790 | B2 | 10/2013 | Winter | |
| 8,555,791 | B2 | 10/2013 | Jin | |
| 8,578,863 | B2 | 11/2013 | Peery | |
| 8,578,865 | B2 | 11/2013 | Haney | |
| D696,882 | S | 1/2014 | Clegg | |
| 8,622,007 | B2 | 1/2014 | Peery | |
| D700,465 | S | 3/2014 | Johnson | |
| 8,677,912 | B1 | 3/2014 | Tsai | |
| 8,683,929 | B2 | 4/2014 | Peery | |
| 8,720,990 | B2 | 5/2014 | Boydston | |
| 8,726,817 | B2 | 5/2014 | Bennett | |
| 8,746,155 | B2 | 6/2014 | Haney | |
| 8,757,069 | B2 | 6/2014 | Peery | |
| D708,462 | S | 7/2014 | Nye | |
| D715,081 | S | 10/2014 | Bennett | |
| 8,857,349 | B2 | 10/2014 | Peery | |
| 8,904,943 | B2 | 12/2014 | Jin | |
| 8,943,982 | B2 | 2/2015 | Peery | |
| D727,074 | S | 4/2015 | Johnson | |
| 8,997,663 | B2 | 4/2015 | Peery | |
| D733,475 | S | 7/2015 | Johnson | |
| D734,081 | S | 7/2015 | Johnson | |
| 9,101,209 | B2 | 8/2015 | Bennett | |
| D739,672 | S | 9/2015 | Johnson | |
| D739,673 | S | 9/2015 | Johnson | |
| 9,138,050 | B2 | 9/2015 | Peery | |
| D742,671 | S | 11/2015 | Johnson | |
| 9,173,482 | B2 | 11/2015 | Peery | |
| 9,192,229 | B2 | 11/2015 | Peery | |
| 9,192,230 | B2 | 11/2015 | Clegg | |
| D748,418 | S | 2/2016 | Johnson | |
| 9,277,808 | B2 | 3/2016 | Cai | |
| 9,307,831 | B2 | 4/2016 | Peery | |
| D756,694 | S | 5/2016 | Johnson | |
| 9,351,563 | B2 | 5/2016 | Bennett | |
| D759,411 | S | 6/2016 | Johnson | |
| 9,486,076 | B2 | 11/2016 | Peery | |
| 9,532,644 | B2 | 1/2017 | Nye | |
| 9,549,612 | B2 | 1/2017 | Peery | |
| 9,591,918 | B2 | 3/2017 | Nye | |
| 9,642,459 | B2 | 5/2017 | Peery | |
| 9,661,916 | B2 | 5/2017 | Peery | |
| 9,730,514 | B2 | 8/2017 | Peery | |
| 9,763,513 | B2 | 9/2017 | Cai | |
| 9,763,517 | B2 | 9/2017 | Peery | |
| 9,848,699 | B2 | 12/2017 | Peery | |
| 10,092,091 | B1 | 10/2018 | Wang | |
| D863,853 | S | 10/2019 | Johnson | |
| D864,637 | S | 10/2019 | Johnson | |
| 10,932,560 | B2 | 3/2021 | Leng | |
| 11,324,311 | B2 | 5/2022 | Johnson | |
| 11,730,262 | B2 | 8/2023 | Johnson | |
| 11,766,116 | B2 | 9/2023 | Johnson | |
| 11,766,117 | B2 | 9/2023 | Johnson | |
| 11,930,919 | B2 | 3/2024 | Johnson | |
| 2003/0217676 | A1 | 11/2003 | Strong et al. | |
| 2003/0233968 | A1 * | 12/2003 | Strong | A47B 13/003 108/132 |
| 2005/0103239 | A1 | 5/2005 | Neunzert | |
| 2005/0160950 | A1 | 7/2005 | Haney | |
| 2005/0274306 | A1 | 12/2005 | Strong | |
| 2006/0230989 | A1 | 10/2006 | Haney et al. | |
| 2007/0199483 | A1 | 8/2007 | Peery | |
| 2008/0254261 | A1 * | 10/2008 | Tamada | B29C 49/0411 264/261 |
| 2011/0253015 | A1 | 10/2011 | Trimble | |
| 2012/0024201 | A1 | 2/2012 | Haney | |
| 2013/0055930 | A1 | 3/2013 | Peery | |
| 2013/0081560 | A1 | 4/2013 | Peery | |
| 2013/0291481 | A1 | 11/2013 | Haney | |

(56) References Cited

U.S. PATENT DOCUMENTS

| | | | |
|---|---|---|---|
| 2014/0060399 | A1 | 3/2014 | Peery |
| 2014/0175710 | A1 | 6/2014 | Groman |
| 2016/0051049 | A1 | 2/2016 | Peery |
| 2019/0150608 | A1 | 5/2019 | Johnson |
| 2020/0214440 | A1 | 7/2020 | Johnson |
| 2021/0022502 | A1 | 1/2021 | Jiang |
| 2021/0330073 | A1 | 10/2021 | Choi |
| 2022/0031072 | A1 | 2/2022 | Lin |
| 2022/0281204 | A1 | 9/2022 | Jiang |
| 2022/0288835 | A1 | 9/2022 | Jiang |
| 2023/0062885 | A1 | 3/2023 | Johnson |
| 2024/0008638 | A1 | 1/2024 | Johnson |
| 2024/0008639 | A1 | 1/2024 | Johnson |
| 2024/0215710 | A1 | 7/2024 | Johnson |

FOREIGN PATENT DOCUMENTS

| | | | | |
|---|---|---|---|---|
| EP | 3000353 | | 3/2016 | |
| WO | WO-2005075176 | A1 * | 8/2005 | ..... B29C 49/0031 |
| WO | 2017045579 | | 3/2017 | |
| WO | 2017147245 | | 8/2017 | |
| WO | 2021013264 | | 1/2021 | |

OTHER PUBLICATIONS

U.S. Appl. No. 29/594,832, filed Feb. 22, 2017, Nye, et al.
U.S. Appl. No. 29/594,833, filed Feb. 22, 2017, Nye, et al.
U.S. Appl. No. 29/594,835, filed Feb. 22, 2017, Nye, et al.
U.S. Appl. No. 29/594,831, filed Feb. 22, 2017, Nye, et al.
Examiner's Report for Canadian Patent Appl. No. 3007820 filed on Jan. 27, 2020.
International Search Report and Written Opinion mailed May 16, 2017, in related PCT Application No. WO2017147245A1 .
International Preliminary Report on Patentability from PCT/US2017/019046 dated Aug. 28, 2018.
Examination Report from Australian Patent Application No. 2017223575 dated Sep. 18, 2018.
Examination Report from Canadian Patent Application No. 3,007,820 dated Mar. 1, 2019.
Engineering Library, Beam Torsion from "stress Analysis Manual" Air Force Flight Dyamics Laboratory, Oct. 1986 https://engineeinglibrary.org/reference/beam-torsion-ari-force-stress (year 1986).
Science Direct, Closed Section Beam excerpts from various books of dates, https://www.science direct.com/topics/engineering/closed-section-beam (year: 2022).

* cited by examiner

BLOW-MOLDED PLASTIC STRUCTURES

CROSS-REFERENCE TO RELATED APPLICATIONS

The present invention claims priority to and the benefit of U.S. Provisional Patent Application Ser. No. 62/298,896, entitled Blow-Molded Plastic Structures, which was filed on Feb. 23, 2016, and is hereby incorporated by reference in its entirety.

BACKGROUND

Field of the Invention

The present invention generally relates to structures constructed from blow-molded plastic and, in particular, to blow-molded plastic structures that may have a decreased height or thickness.

Description of Related Art

It is known to construct various objects and items, and parts and components of various objects and items, from plastic. For example, tables, chairs, partitions, walls, and sports equipment may be at least partially constructed from plastic. It is also known to construct these and other items from blow-molded plastic. As known to those skilled in the art, blow-molded plastic structures include an outer wall that encloses a hollow interior space. During the blow-molding process, air or gas is injected into the hollow interior space and the gas helps mold the plastic into the desired shape by facilitating engagement of the plastic with the faces of the mold. The gas also keeps opposing surfaces separated during the molding process so that the blow-molded plastic structure can be correctly formed. If opposing surfaces unintentionally touch during the blow-molding process, the surfaces may stick together and that may result in failure. Thus, gas is injected into the hollow interior space so that the plastic takes the shape of the mold and correctly forms the blow-molded plastic structure. Because blow-molded structures include a hollow interior space, many blow-molded structures are not high-strength. In fact, many known blow-molded structures are relatively low-strength and are unable to support a significant amount of weight or force.

In order to increase the strength of conventional blow-molded plastic structures, such as blow-molded plastic table tops, it is known to include strengthening ribs or beams that are integrally formed in the underside of the table top. For example, strengthening ribs may be located in a center portion of the table top and the ribs may be intended to help prevent sagging of the center portion of the table top. The strengthening ribs are typically large, elongated portions that have the general shape of a beam and extend along the length or width of the table top. The strengthening ribs may increase the overall strength or structural integrity of the table top, but the ribs require the blow-molded plastic structure to be constructed with thicker outer walls so that the large, elongated ribs are properly formed. The strengthening ribs also require thicker outer walls so that the ribs do not undesirably sag or deform during the manufacturing process. Disadvantageously, the thicker outer walls require additional plastic materials to be used, which increases cost and weight. In addition, the thicker outer walls retain more heat during the manufacturing process. Thus, a longer cooling time is required during the manufacturing process in order to allow the thicker outer walls to cool. This undesirably increases the length of the manufacturing process because the blow-molded plastic structures cannot be removed from the mold until the tops are sufficiently cooled.

Conventional blow-molded plastic table tops may include several large strengthening ribs to strengthen various portions of the table top. For example, strengthening ribs may be placed near opposing ends of the table top in order to increase the strength in those areas. Additionally, strengthening ribs may be placed near the center of the table top to help prevent the table top from undesirably bending and to allow the table top to support additional weight. These strengthening ribs often protrude downwardly from the underside of the table top and may have large profiles to create relatively strong supporting structures. Disadvantageously, the large, protruding ribs may decrease the amount of room underneath the table top and may limit potential design considerations for the table top.

In order to increase the strength of conventional table tops, it is known to increase the number of strengthening ribs. The additional ribs may require more plastic materials to form the ribs, thicker outer walls of the table top, and a larger area on the underside of the table top. The added strengthening ribs may also interfere with other desired features or components of the table, such as allowing the legs of the table to be folded into a collapsed position. The extra strengthening ribs may also prevent the table top from being used in connection with a fold-in-half table.

While the strengthening ribs may prevent large portions of the table top from sagging, the ribs may allow smaller, localized portions of the table top to sag. In particular, because the distance between the table top and the bottom portion of the rib may be greater than the distance between the upper and lower surfaces of the table top, localized portions of the table top may sag. Additionally, the strengthening ribs may support localized portions of the table top differently and those portions of the table top may have different characteristics than other portions of the table top. Thus, different portions of the table top may support different amounts of weight or force before deflecting or bending. In addition, the upper surface of the table top may be uneven because different portions of the table top may be supported differently.

BRIEF SUMMARY OF THE INVENTION

A need therefore exists for structures constructed from blow-molded plastic that eliminate the above-described disadvantages and problems.

One aspect is large, thin structures that may be constructed from blow-molded plastic. The large, thin blow-molded plastic structures may have a first or upper surface, a second or lower surface, and a hollow interior portion that is at least partially disposed between the first and second surfaces. Advantageously, as described below, the first and second surfaces may be separated by a distance that allows a much thinner or reduced height blow-molded plastic structure to be constructed than previously thought possible by those skilled in the art.

Another aspect is large, thin blow-molded plastic structures may have a generally planar configuration. These large, thin, generally planar structures constructed from blow-molded plastic may be used to construct a wide variety of structures such as table tops, basketball backboards, walls, floors, roofs, and the like. These structures may include at least one surface that is generally disposed in a plane such as an upper surface of a table top, front surface of a basketball backboard, an interior and/or exterior surface of a wall, etc. After reviewing this disclosure, one skilled in the art will appreciate that a variety of structures may be constructed from blow-molded plastic that is thinner or has a decreased height compared to previously known blow-molded plastic structures.

Still another aspect is large, thin blow-molded plastic structures may have opposing surfaces separated by a distance and the distance may be generally constant. The opposing surfaces may be generally planar, curved, bent, rounded, or have other desired shapes and configurations. For instance, the opposing surfaces may be separated by a generally constant distance and the panel may have a curvilinear configuration. The opposing surfaces, however, do not have to be separated by a generally constant distance and the blow-molded plastic structures may include one or more outwardly extending projections, protuberances, and the like. For example, the blow-molded plastic structure may be a table top and a center portion of the table top may have a large, thin, generally planar configuration and an outer portion or perimeter of the table top may include a downwardly extending lip. The blow-molded plastic structures may also one or more inwardly extending portions such as grooves, channels, depressions, and the like. While structures such as table tops and panels may have generally rectangular configurations, it will be appreciated that table tops, panels, and other structures could have other suitable shapes, sizes, arrangements, and configurations such as circular, square, and the like.

Still yet another aspect is large, thin blow-molded plastic structures may have a nominal thickness equal to or significantly less than one-half inch. It was previously thought by those skilled in the art that the minimum thickness had to be significantly larger than one-half inch such as three-quarters of an inch or more. It is a surprising and unexpected result that large, thin blow-molded plastic structures can be constructed with a nominal thickness generally equal to or significantly less than one-half inch because it was previously believed that a thickness significantly more than one-half inch was required. A thickness that is considerably less than one-half inch may be reduced in size by at least ten percent (10%), at least twenty percent (20%), at least thirty percent (30%), at least forty percent (40%), at least fifty percent (50%), at least sixty (60%), at least seventy percent (70%), or more. A structure may be considered to be a large blow-molded plastic structure if it has an area of at least one, two, four, six, eight, ten, or more square feet. While large, thin blow-molded plastic structures may be described as having a thickness (e.g., a distance between two surfaces) that is generally equal to or significantly less than one-half inch, it will be appreciated that large, thin blow-molded plastic structures could also be described as having a height generally equal to or significantly less than one-half inch (e.g., a distance between upper and lower surfaces).

Yet another aspect is large, thin blow-molded plastic structures may include at least one large area (e.g., an area of at least one, two, four, six, eight, ten, or more square feet) with a nominal thickness generally equal to or less than one-half inch. For example, at least a portion of the large, thin blow-molded plastic structures may include an area that is at least one square foot and a nominal thickness that is generally equal to or less than one-half inch. In addition, one or more surfaces of the large, thin blow-molded plastic structure may have a generally planar configuration. A table top, for instance, could be a large, thin, generally planar blow-molded plastic structure because a center portion of the table top may have an area at least two, four, six or more square feet, a nominal thickness generally equal to or less than one-half inch, and a generally planar configuration. The table top may also include a downwardly extending lip and other inwardly or outwardly extending structures, which may not be part of the nominal thickness of the table top.

A further aspect is large, thin, generally planar blow-molded plastic structures may include an outer wall, which may have an outer wall thickness, and an interior space, which may be hollow. For example, large, thin, generally planar blow-molded plastic structures may include a first surface, an opposing second surface, and a hollow interior portion that is at least partially disposed between the first and second surfaces. The first surface, second surface, and hollow interior portion may be integrally formed during the blow-molding process as part of a unitary, one-piece structure. The first surface may be generally planar, flat, even and/or smooth, and the first surface may be an upper or working surface of a table top, a front surface of a basketball backboard, an outer or inner surface of a wall (such as a sidewall), an outer or inner surface of a floor or roof panel, and the like. The second surface may also be generally planar, flat, even and/or smooth, and/or the second surface may include one or more grooves, channels, ridges, and the like. It will be appreciated that the first and/or second surfaces may be generally smooth, flat, even, and/or planar surfaces; and/or the first and/or second surfaces may include one or more inwardly and/or outwardly extending portions such as grooves, channels, ridges, projections, protrusions, and the like. The first and second surfaces may be separated or spaced apart by a gap, space, or distance. The distance separating the first and second surfaces, which may be referred to as the thickness or height, may be generally constant or may vary depending, for example, upon the intended use of the structure.

Another further aspect is one or more depressions or "tack-offs" may be formed in the blow-molded plastic structure. For example, one or more depressions may be disposed in the second surface of the blow-molded plastic structure. In particular, a plurality of depressions may be disposed in the second surface of the blow-molded plastic structure. The plurality of depressions may include two or more depressions that are disposed in a pattern or array. The pattern, for instance, may include depressions disposed in a regular and/or repeating configuration. At least some of the depressions may have a generally uniform or consistent size, shape, configuration and/or arrangement. For instance, the pattern of depressions may include depressions with a generally uniform or consistent size, shape, configuration and/or arrangement. The depressions may cover a portion, majority, substantially all, or an entire portion, surface or area of the blow-molded plastic structure. For example, at least some of the depressions in the plurality of depressions may be disposed in a pattern and the depressions may have a generally uniform or consistent size, shape, configuration and/or arrangement, and the depressions may cover at least a portion, majority, substantially all, or an entire portion, surface or area of the blow-molded plastic structure. In an exemplary configuration, the depressions may cover at least substantially the entire surface of the blow-molded plastic structure, such as the lower surface of a table top, rear surface of a basketball backboard, or inner surface of a panel. The depressions may be sized and configured to provide at least a portion of the blow-molded plastic structure with generally uniform or similar properties and characteristics. For example, if the blow-molded plastic structure is a table top, the depressions may be sized and configured so that the upper surface of the table has generally uniform or similar properties and characteristics. In an exemplary embodiment, a plurality of depressions may be disposed in the lower surface of a table top and the depressions may help support the upper surface so that the upper portion of the table top has generally uniform or similar properties and characteristics such as smoothness, evenness, uniformity, strength, stiffness, rigidity, and the like.

As discussed above, the hollow interior portion of a blow-molded plastic structure may be filled with a gas, such as air, during the blow-molding process. For example, gas may be injected or inserted into the hollow interior portion during the blow-molding process and gas may flow within the hollow interior portion during the blow-molding process. The gas may keep one or more surfaces, such as first and second opposing surfaces, separated by a minimum distance during the molding process because unintended contact of the surfaces may result in failure. The gas may also position the plastic materials within the mold, and facilitate or enable the plastic materials to take the shape of the mold during the blow-molding process. Those skilled in the art recognize that proper gas flow and pressure during the blow-molding process is required. For example, if gas does not correctly or completely flow into all desired areas of the hollow interior portion during the blow-molding process or if the correct amount or pressure of gas is not properly obtained within all desired areas of the hollow interior portion during the blow-molding process, the blow-molded structure may not be correctly formed and failure may result. Therefore, failure may result if (1) gas does not properly flow during the blow-molding process; (2) the correct pressure is not obtained; and (3) a minimum distance between surfaces is not maintained. One skilled in the art previously thought, among other reasons, that large, thin blow-molded plastic structures could not be conventionally constructed with a nominal thickness generally equal to or less than one-half inch because it was not possible to obtain the required gas flow and pressure while maintaining the required distance separating opposing surfaces.

In contrast to previously known blow-molded plastic structures and processes, large, thin blow-molded plastic structures can be constructed with a nominal thickness generally equal to or less than one-half inch. Advantageously, sufficient gas flow, gas pressure, and minimum separation distance between surfaces can be maintained during the blow-molding process to allow large, thin blow-molded structures with a nominal thickness generally equal to or less than on-half inch to be constructed. In greater detail, one skilled in the art previously thought that large blow-molded plastic structures required opposing surfaces to be separated by significantly more than one-half inch to provide sufficient gas flow and pressure during the blow-molding process. That is, the previous lower limit for separating opposing surfaces of large blow-molded plastic structures was significantly more than one-half inch because a gap of at least that size was required, among other reasons, to allow the gas to properly flow during the blow-molding process. If opposing surfaces of a large blow-molded plastic structure were separated by one-half inch or less, it was previously thought that the gas would not flow throughout the entire hollow interior portion during the blow-molding process and/or the gas would not have sufficient pressure. In addition, if the distance between two large, opposing walls was generally equal to or less than one-half inch, it was previously thought the opposing walls would not remain separated during the blow-molding process. In particular, it was previously thought the walls would touch and the walls would at least partially or completely mesh or mash together, which would result in failure. Additionally, it was previously thought that if the opposing walls were generally equal to or less than one-half inch apart, depressions could not be formed in the walls. For instance, it was previously thought that depressions could not be formed in walls that were spaced generally equal to or less than one-half inch apart because undesired webbing or improper formation of the depressions would occur. The webbing, improper formation of the depressions, and other irregularities would create holes, voids or discontinuities in the structure, which were thought to prevent depressions from being created in surfaces separated by one-half inch or less. Thus, for these and other reasons, it was previously thought that opposing surfaces had to be separated by significantly more than one-half inch not only to allow depressions to be formed but also to allow the large blow-molded plastic structure to be created.

Yet another further aspect is large, thin blow-molded plastic structures may be constructed with closely spaced depressions and less plastic materials may be required to construct the structure. For example, opposing walls of large, thin blow-molded plastic structures may be spaced apart by one-half inch or considerably less than one-half inch and a plurality of closely spaced depressions in one surface may provide significant support for the opposing surface. The added support provided by the closely spaced depressions may allow the structure to be constructed with a thinner outer wall thickness. The thinner outer wall thickness may allow less plastic materials to be used even though considerably more depressions are formed in the structure. Advantageously, because the opposing surfaces are separated by a smaller distance than previously thought possible, the depressions may have a shorter height and that may facilitate the structure being constructed with a thinner wall thickness and/or less plastic materials.

Still yet another further aspect is large, thin blow-molded plastic structures may be constructed with opposing walls separated by one-half inch or significantly less than one-half (0.5) inch. For example, large, thin, generally planar structures may be constructed with opposing walls separated by about 0.30 inches, about 0.25 inches, about 0.20 inches, about 0.15 inches, or about 0.10 inches. Thus, the nominal thickness may be reduced by about forty percent (40%), about fifty percent (50%), about sixty percent (60%), about seventy percent (70%), about eighty percent (80%), or more than the current minimum thickness which is more than 0.50 inches.

Another aspect is large, thin blow-molded plastic structures may have increased strength and be lightweight. The increased strength may be provided by the plurality of closely spaced depressions and the reduced weight may be provided by the decrease in outer wall thickness. For example, the nominal thickness of the outer wall may be reduced to about 0.05 inches, about 0.045 inches, about 0.04 inches, about 0.035 inches, about 0.03 inches, or less. For example, the nominal wall thickness of blow-molded plastic table tops is currently about 0.067 inches and the nominal wall thickness may be reduced by about twenty-five percent (25%), about thirty-three percent (33%), forty percent (40%), forty-eight (48%), about fifty-five percent (55%), or more. Significantly, the decreased nominal wall thickness may allow the blow-molded plastic structure to be lighter weight and/or be constructed with less plastic materials.

Yet another aspect is large, thin blow-molded plastic structures with a nominal thickness generally equal to or less than one-half inch and a decreased outer wall thickness may be used to create a wide variety of items and objects such table tops, chair seats, chair backs, basketball backboards, walls, storage bins, sports equipment and the like. One or more surfaces may be at least substantially planar, such as the upper surface of a tabletop or the front surface of a basketball backboard. One or more surfaces may include a plurality of depressions, such as the lower surface of a tabletop or the rear surface of a basketball backboard.

Still another aspect is large, thin blow-molded plastic structures with a nominal thickness generally equal to or less than one-half inch may include a plurality of closely spaced depressions. In particular, the distance between adjacent depressions in the plurality of depressions may be substantially decreased because the distance between opposing surfaces may be substantially decreased. It was a surprising and unexpected result that a plurality of closely spaced depressions could be formed in large, thin, generally planar blow-molded plastic structures with a nominal thickness generally equal to or less than one-half inch because it was previously thought closely spaced depressions could be not formed using a blow-molding process if the distance between adjacent depressions was too small. For instance, as discussed above, it was previously thought that webbing, discontinuities and/or other irregularities would be formed between the closely spaced depressions. It was also previously thought that the plastic materials would not stretch or properly form the depressions without creating holes or voids, which may allow gas to unintentionally escape during the blow-molding process (which may be referred to as a "blow-out") and this would result in failure. Contrary to conventional thought, a plurality of closely spaced depressions may be formed in opposing surfaces of large, thin blow-molded plastic structures that are separated by a distance generally equal to or less than one-half inch.

Advantageously, the plurality of closely spaced depressions in large, thin blow-molded plastic structures with a nominal thickness generally equal to or less than one-half inch may allow the thickness of the outer wall of the blow-molded plastic structure to be decreased. The decrease in outer wall thickness may allow structures to be constructed from considerably less plastic materials. The reduced amount of plastic materials may save resources and reduce costs. The decrease in outer wall thickness may also allow these structures to cool more quickly, removed sooner from the mold, and/or decrease manufacturing or cycle time. In addition, because the closely spaced depressions may provide additional support for opposing surfaces, this may allow these structures to be removed from the mold at higher temperatures. This may also reduce manufacturing or cycle time, which may further increase output and/or efficiency.

A further aspect is large, thin blow-molded plastic structures with a nominal thickness generally equal to or less than one-half inch may have closely spaced depressions that are generally uniform, consistent, and/or standardized in size, shape, configuration, arrangement, and/or spacing. A generally consistent arrangement or pattern of depressions may help create a structure with generally uniform characteristics and/or properties. For example, a generally constant pattern of depressions may create a structure with generally uniform strength and structural integrity.

Another further aspect is large, thin blow-molded plastic structures with a Nominal thickness generally equal to or less than one-half inch may have a low profile, which may allow the thickness or height of a structure to be minimized. For example, the height of a table may be decreased if the table top has a low profile and that may allow the table to be more efficiently shipped and/or stored. In particular, additional tables may be disposed in a storage container and less space may be required to store the tables if the table top has a lower profile.

Still another further aspect is large, thin blow-molded plastic structures with a nominal thickness generally equal to or less than one-half inch may be used to create a table in which the frame is disposed closer to an upper surface of the table top. For instance, a blow-molded plastic table top may have a nominal thickness generally equal to or less than one-half inch and an upper portion of the frame may be disposed closer to an upper surface of the table top because of the decreased thickness of the table top. In an exemplary configuration, the table top may have one or more areas of reduced thickness and the frame may be connected to one or more portions of the table top with reduced thickness. If the frame is connected to an area of reduced thickness and the table top has a nominal thickness generally equal to or less than one-half inch, the height of the table may be reduced and/or the upper portion of the frame may be disposed closer to the upper surface of the table top. The areas of the table top with reduced thickness may have a height of about 0.20 inches, about 0.15 inches, about 0.10 inches, or less. The areas of reduced thickness may include one or more depressions, if desired. The areas of reduced thickness may include one or more compression portions, such as a compression edge or lip. Thus, for example, the frame may be connected to portions of the table top with a nominal thickness generally equal to or less than one-half inch, areas of reduced thickness, and/or compression portions such as a compression edge or lip. The table top may also include one or more compression molded portions, such as a lip, and the lip may be disposed about at least a portion of a perimeter of the table top.

Still yet another further aspect is large, thin blow-molded plastic structures with a nominal thickness generally equal to or less than one-half inch may include portions that are sized and configured to receive one or more fasteners. The fasteners, for example, may be used to connect a blow-molded plastic table top and frame. In greater detail, the table top may include one or more fastener receiving portions that are sized and configured to receive a fastener. The fastener receiving portions may facilitate attachment of the fastener and the table top. It will be appreciated that the fastener receiving portion may be disposed in a portion of the table top with a nominal thickness generally equal to or less than on-half inch, a portion of the table top with a reduced thickness, and/or a portion of the table top with a compression portion such as a compression edge or lip. The fastener receiving portion may allow, for instance, a fastener to be connected to any desired portion of the table top and may allow the frame to be connected to any desired portion of the table top.

Advantageously, large, thin blow-molded plastic structures with a nominal thickness generally equal to or less than one-half inch and closely spaced depressions may be constructed and these structures may not include significant sags, ripples, or uneven surfaces. In particular, blow-molded plastic structures may include one or more areas with the following: (i) areas at least one square foot in size; (ii) opposing surfaces that are separated by a nominal distance generally equal to or considerably less than one-half inch; and (iii) a plurality of closely spaced depressions. These and other features may also create structures with areas that have generally uniform properties and characteristics, such as strength, structural integrity, rigidity, firmness, resistance to bending, and the like.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF PREFERRED EMBODIMENTS

Figure 1:
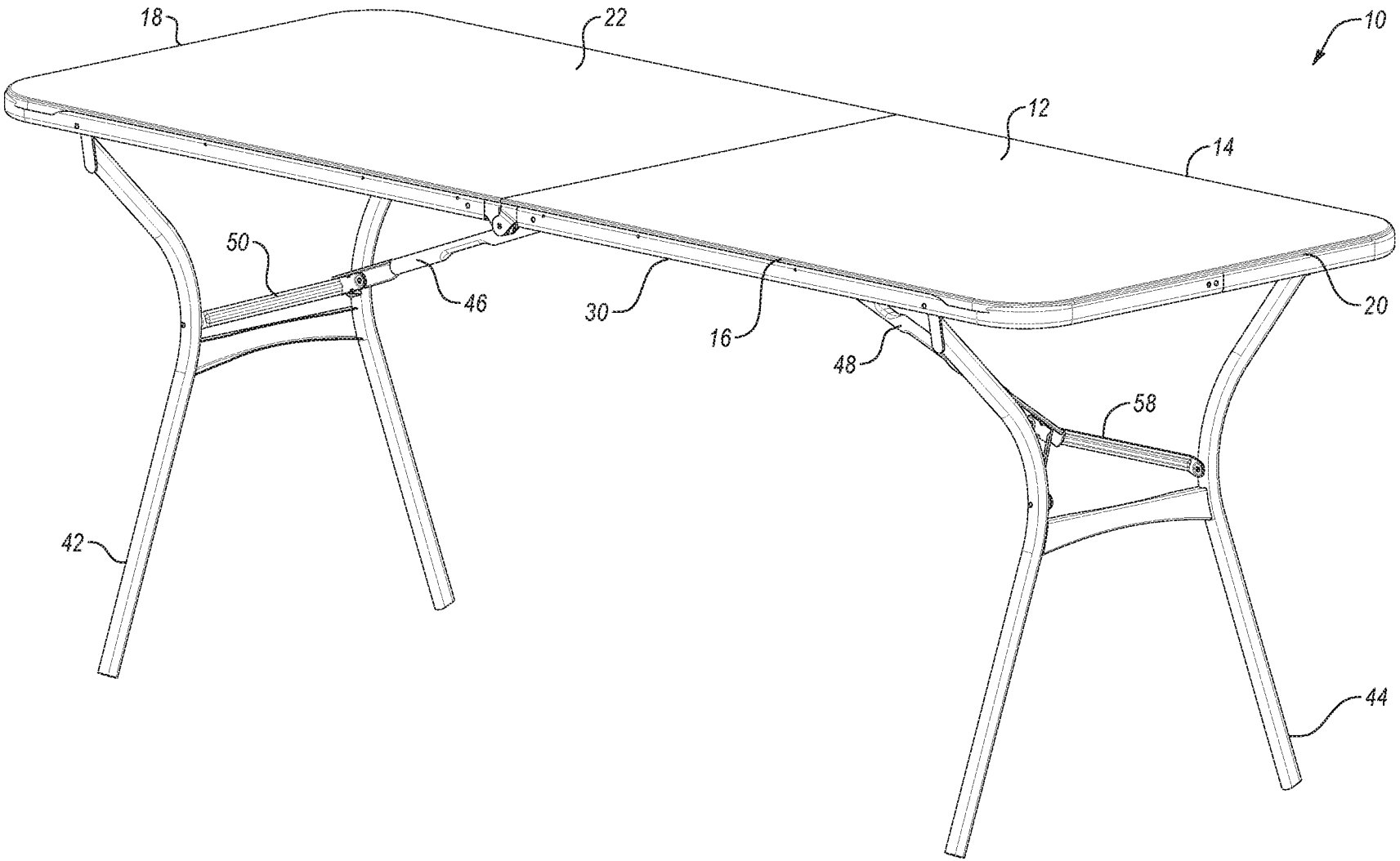
FIG. 1 is an upper perspective view of an exemplary embodiment of a table, the table including a table top comprising large, thin, generally planar blow-molded plastic structure with a nominal thickness generally equal to or less than one-half inch.

The present invention is generally directed towards large, thin blow-molded plastic structures. The large, thin blow-molded plastic structures may have areas with a size of at least one square foot, a nominal thickness generally equal to or less than one-half inch, at least one surface with a generally planar configuration, and/or one or more depressions formed in or one more surfaces. For convenience and readability, such structures may be referred to as panels but the principles of the present invention are not limited to panels. It will be understood that, in light of the present disclosure, such large, thin blow-molded plastic structures may have a variety of shapes, sizes, configurations, and arrangements. Exemplary embodiments of structures that may be made in accordance with the present disclosure may include table tops, chair seats, chair backs, basketball backboards, wall panels, roof panels, floor panels, storage bins, sports equipment, and the like Additionally, to assist in the description of exemplary embodiments, words such as top, bottom, front, rear, right and left may be used. It will be appreciated that the exemplary embodiments can be disposed in other positions, used in a variety of situations, and may perform one or more functions. In addition, the drawings, which may be to scale, illustrate various shapes, sizes, configurations, arrangements, aspects and features of the exemplary embodiments. It will be appreciated that structures made in accordance with the present disclosure may have other suitable shapes, sizes, configurations, arrangements, aspects, and features. A detailed description of exemplary embodiments of now follows.

As shown in the accompany figures, a table 10 is an exemplary embodiment of a structure that may include a large, thin-blow molded plastic structure. In particular, the table 10 may include a table top 12 and the table top may be a large, thin blow-molded plastic structure with a nominal thickness generally equal to or less than one-half inch. While the tables 10 and the table tops 12 shown in the accompanying figures are exemplary embodiments of large, thin blow-molded plastic structures that may have a nominal thickness generally equal to or less than one-half inch, one of ordinary skill in the art will appreciate after reviewing this disclosure that other blow-molded plastic structures may have one or more such features.

As shown in the accompanying figures, the exemplary table 10 may include a table top 12 with a first side 14, a second side 16, a first end 18, a second end 20, an upper or working surface 22, and a lower or mounting surface 24. A hollow interior portion 26 may be disposed between the upper and lower surfaces 22, 24. The upper surface 22, the lower surface 24, and the hollow interior portion 26 may be integrally formed during the blow-molding process as part of a unitary, one-piece structure. One or more other features, which may be described below, may also be integrally formed with the upper surface 22, the lower surface 24, and/or the hollow interior portion 26 during the blow-molding process as part of a unitary, one-piece structure.

Figure 4:
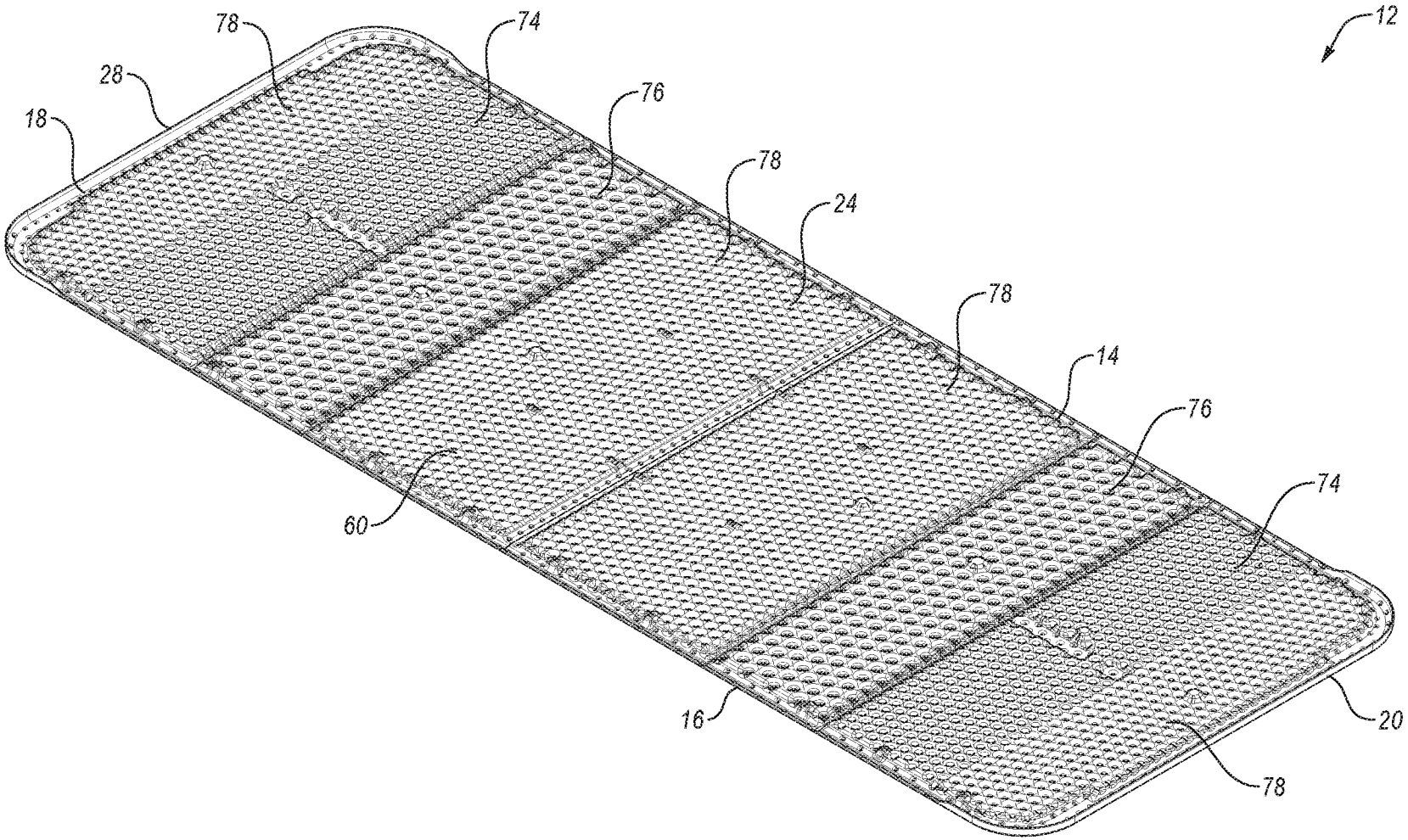
FIG. 4 is a lower perspective view of a portion of the table shown in FIG. 1, showing the table top.
Figure 5:
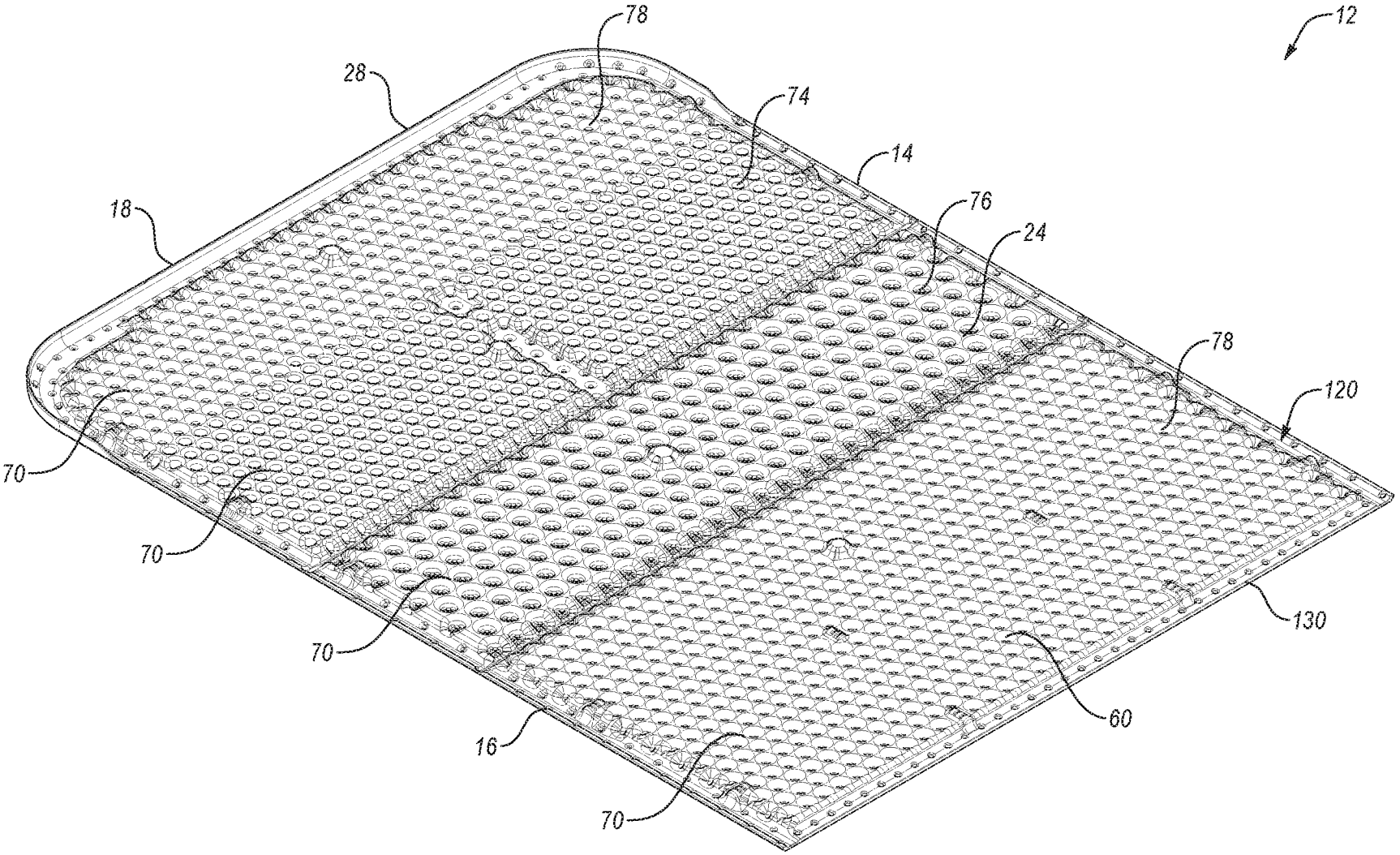
FIG. 5 is an enlarged lower perspective view of a portion of the table top shown in FIG. 4.

As shown in FIGS. 4 and 5, a lip 28 may be disposed about at least a portion of a periphery of the table top 12. The lip 28, which may be disposed about an outer perimeter of the table top 12, may form at least part of an outer edge or boundary of table top. The lip 28 may extend downwardly relative to the lower surface 24 of the table top 12 and the lip may extend around all or one or more portions of table top. The lip 28 may also have different heights. For example, the lip 28 could have a larger height in the corners than the sides or ends of the table top 12. In addition, the lip 28 may only be disposed in the corners, sides, and/or ends of the table top 12. Further, while the lip 28 may extend downwardly relative to the lower surface 24 of the table top 12, the lip may be disposed at any suitable angle and it could be aligned with the upper surface 22 of the table top. All or a portion of the lip 28 may be compression molded and the lip may be integrally formed with the table top 12 during a blow-molded process as part of a unitary, one-piece structure. It will be understood that the table top 12 and the lip 28 may also be formed from two or more pieces that are subsequently attached by any suitable mechanism or method such as fasteners, adhesives, and like. It will also be understood that the lip 28 is not required.

The table 10 may include a frame 30 and the frame may include a first side rail 32 and a second side rail 34. The first side rail 32 may be disposed at least proximate and substantially parallel to the first side 14 of the table top 12 and the second side rail 34 may be disposed at least proximate and substantially parallel to the second side 16 of the table top. The side rails 32, 34 may extend generally along the length of the table top 12. The length and configuration of the side rails 32, 34 may depend, for example, upon the length and configuration of the table top 12. The side rails 32, 34 may include one or more components depending, for example, if the table 10 is a fold-in-half table. The frame 30 may also include a first end rail 36 that is disposed along the first end 18 of the table top 12 and a second end rail 38 that is disposed along the second end 20 of the table top. The frame 30 may also include one or more corners and the corners may separate components or part of the side rails 32, 34 and/or end rails 36, 38. The corners of the frame 30 may be generally aligned with corresponding corners of the table top 12. In addition, the frame 30 may be generally aligned with the lip 28. For example, an outer surface of the frame 30 may be generally aligned with and directly adjacent or contacting an inner surface of the lip 28. The frame 30 may be sized and configured to support the outer edges or perimeter of the table top 12. One or more portions of the frame 30, however, could be spaced inwardly from the outer perimeter of the table top 12. The frame 30 may also be sized and configured to help prevent bowing, twisting, or deformation of table top 12. It will be appreciated that the frame 30 could have a variety of shapes, sizes, configurations, and/or arrangements depending, for example, upon the size and configuration of the table 10 or table top 12. It will also be appreciated that the frame 30, side rails 32, 34, and/or end rails 36, 38 may not be required.

The frame 30 may be attached to the table top 12 by one or more fasteners, such as screws, bolts, rivets and the like. For example, the table top 12 may include one or more attachment portions that are sized and configured to facilitate attachment of the frame 30 and the table top. The table top 12 may also include one or more frame receiving portions that are sized and configured to receive a portion of the frame 30. Additionally, the table top 12 may be sized and configured to allow an upper portion of the frame 30 to be disposed proximate the upper surface 22 of the table top 12. Further, the table top 12 and/or the frame 30 may be sized and configured to minimize the overall height of the table top and the frame, which may allow a table 10 with a thinner configuration to be constructed.

In greater detail, the table top 12 may include one or more fastener receiving portions 40 that are sized and configured to receive at least a portion of a fastener. The fastener receiving portions 40 may include one or ribs, engaging portions, and the like that are sized and configured to help provide secure engagement of the fastener and the fastener receiving portion. Advantageously, the fastener receiving portions 40, which may be integrally formed with the table top 12 as part of a unitary, one-piece structure, may allow secure attachment of the frame 30 to the table top 12 because the table top 12 may have such a small thickness, height, or thin configuration that fasteners would not be able to be securely attached directly to the table top.

The fastener receiving portions 40 may allow the frame 30 and the table top 12 to be directly connected. For example, in one exemplary embodiment, a fastener could connect the frame 30 and the fastener receiving portion 40 to securely connect the frame and the table top 12. In another exemplary embodiment, a fastener could connect the lip 28, the frame 30, and the fastener receiving portion 40. In yet another exemplary embodiment, a fastener could connect a compression molded portion of the table top 12, the frame 30, and the fastener receiving portion 40. One skill in the art will understand, after reviewing this disclosure, that other suitable means or methods for connecting the frame 30 and/or the table top 12 may be employed, including, but not limited to, mechanical connectors, glues, epoxies, bonding materials, and the like.

Figure 2:
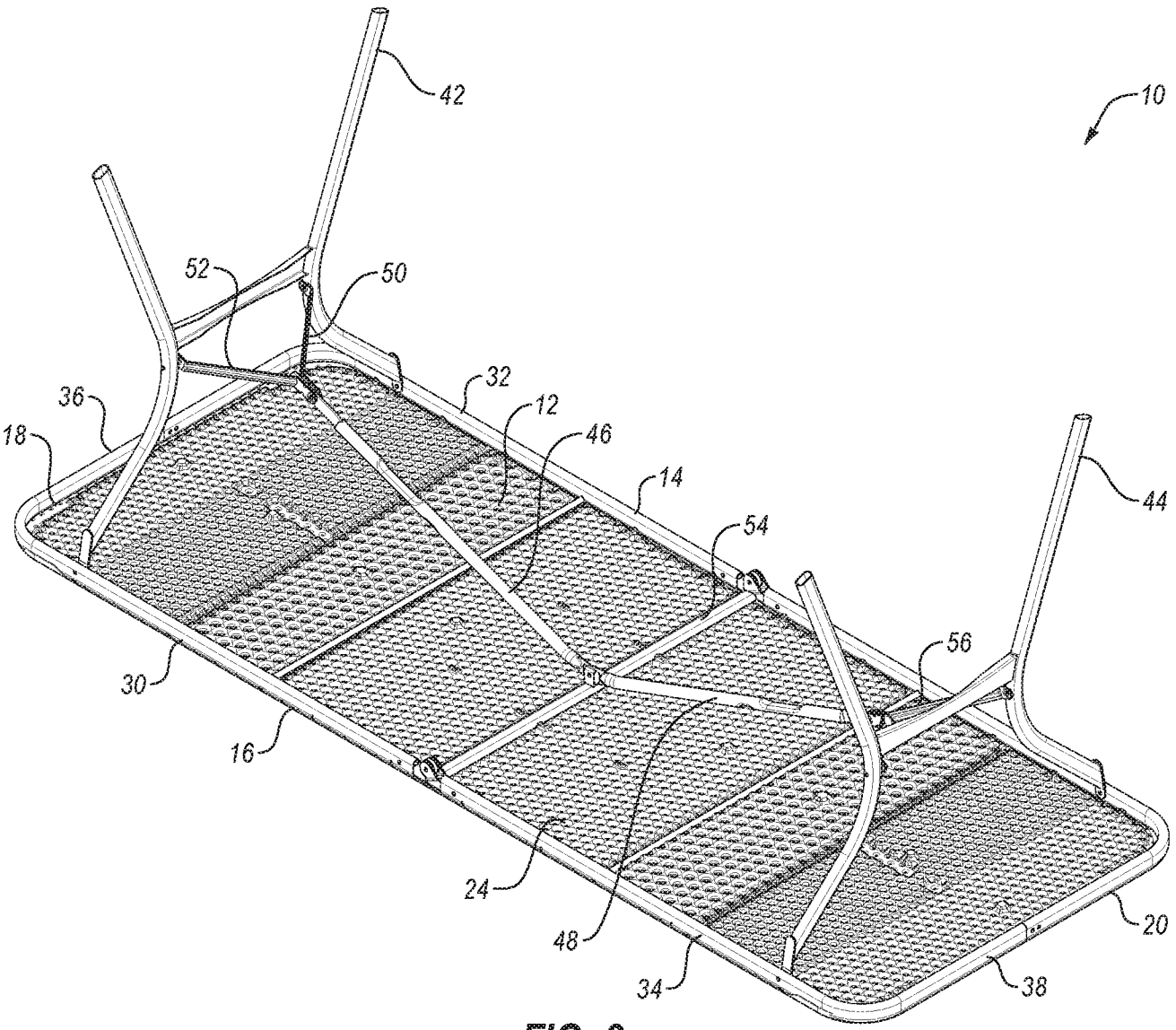
FIG. 2 is a lower perspective view of the table shown in FIG. 1, illustrating the table legs or leg assemblies in an extended position.
Figure 3:
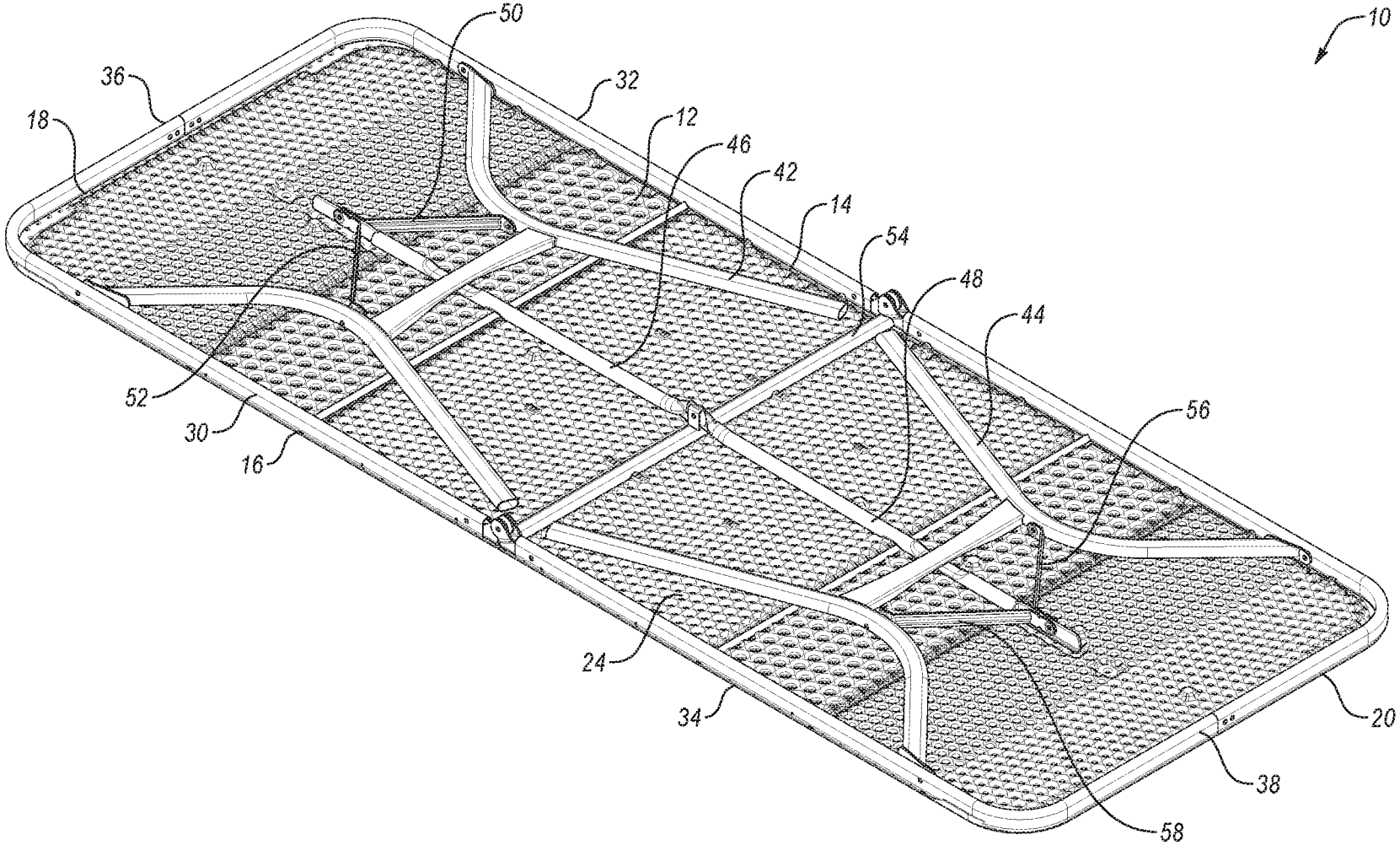
FIG. 3 is another lower perspective view of the table shown in FIG. 1, illustrating the table legs in a collapsed position.

As shown in FIGS. 1-3, for example, the table 10 may include a first leg assembly or support pedestal 42 and a second leg assembly or support pedestal 44. The first and second leg assemblies 42, 44 may be movable relative to the table top 12. For example, the first and second leg assemblies 42, 44 may be movable between an extended or use position in which the leg assemblies extend outwardly relative to the table top 12, such as illustrated in FIGS. 1 and 2, and a collapsed or storage position in which the leg assemblies are positioned at least proximate and generally parallel to the lower surface 24 of the table top, such as illustrated in FIG. 3. The leg assemblies 42, 44 may be pivotally attached to the frame 30, the table top 12, or other suitable portions of the table 10. It will be appreciated that the leg assemblies 42, 44 do not have to be movable relative to the table top 12, the table 10 may include any suitable number of legs and/or leg assemblies, and the leg assemblies may have other suitable shapes, sizes, configurations, and arrangements depending, for example, upon the intended use of the table.

One or more support braces 46, 48, such as shown in FIGS. 2 and 3, may be connected to the leg assemblies 42, 44 and the table top 12. For example, as shown in the accompanying figures, one end of the support brace 46 may include a pair of arms 50, 52 that are attached to the first leg assembly 42 and the other end of the support brace may be attached to another portion of the table 10, such as a cross bar 54 that extends across at least a portion of the table top 12. Similarly, the support brace 48 may include a pair of arms 56, 58 that are attached to the second leg assembly 44 and the other end of the support brace may be attached to the cross bar 54. The support braces 46, 48 may include other portions such as brace body, overlapping portions, and a locking mechanism such as a locking ring. The locking ring may slide along at least a portion of the support brace and the locking ring may be sized and configured to fit over the overlapping portions of the support brace when the leg assembly is in the extended position. Advantageously, the locking ring may be used to secure the leg assembly in the extended position. It will be appreciated that other mechanisms may be used to lock the leg assemblies 42, 44 in a desired position. It will also be appreciated that the support braces 46, 48, arms 50, 52, 56, 58, and cross bar 54 may have other suitable shapes, sizes, configurations, and arrangements depending, for example, upon the size and intended use of the table 10.

The table top 12 may include at least one thin profile section 60 that has a large size and a nominal thickness generally equal to or less than one-half inch. The thin profile section 60 may have a generally planar upper surface 22 (which may be a substantially smooth, flat, and/or even surface) and a generally planar lower surface 24 (which may be a surface disposed in generally the same plane and, in an exemplary embodiment, include a plurality of depressions). Any suitable portion of the table top 12 could include the thin profile section 60, such as a center portion of the table top, and the thin profile section 60 may form a minority, majority, substantially all, or the entire table top 12. One skill in the art will appreciate, after reviewing this disclosure, that the thin profile section 60 may form any desired portion or portions of the table top 12.

In the exemplary embodiment shown in FIGS. 2-5, substantially all or the entire table top 12 may comprise a thin profile section 60 (which may or may not include the lip 28). For example, if the table top 12 has a length of about eight (8) feet and a width of about two and one-half (2.5) feet, the table top may have a size of about twenty (20) square feet. If the table top 12 has a length of about six (6) feet and a width of about two and one-half (2.5) feet, the table top may have a size of about fifteen (15) square feet. Thus, the table top 12 may have a thin profile section 60 because it has an area larger than about one square foot, about two square feet, about three square feet, about four square feet, about five square feet, about six square feet, or more. The table top 12 may also have a thin profile section 60 because the upper and lower surfaces 22, 24 may be separated by generally equal to or less than one-half inch. One skilled in the art will appreciate, after reviewing this disclosure, that the thin profile sections 60 may have various suitable shapes, sizes, configurations, and arrangements depending, for example, upon the intended use of the table 10.

A blow-molded plastic structure with a thin profile section 60, whether part of the table top 12 or other structure, may be referred to as a panel for convenience. The panel 60 may have a nominal panel thickness PT, which may be the mean or average thickness of the panel. For example, the nominal panel thickness PT may be the mean or average distance between the upper and lower surfaces 22, 24 of the table top 12. While the panel 60 may have localized areas that are larger or smaller, the nominal panel thickness PT is preferably generally equal to or less than one-half inch. More preferably, the nominal panel thickness PT is significantly less than one-half inch, such as between about 0.40 inches and about 0.10 inches. For example, the nominal panel thickness PT may be about 0.35 inches, about 0.30 inches, about 0.25 inches, about 0.20 inches, about 0.15 inches, or about 0.10 inches. Therefore, after reviewing this disclosure, one skilled in the art will appreciate that the nominal panel thickness PT for large, thin blow-molded plastic structures may be generally equal to or significantly or considerably less than one-half inch.

One skilled in the art will appreciate that the panel 60 may include other features, structures, and portions. For example, the panel 60 may include one or more portions 62 where an injector or needle is inserted into the plastic materials during the blow-molding process. The panel 60 may also include one or more portions 64 which facilitate removal of the panel from the mold during the blow-molding process. The portions 64, for instance, may facilitate ejection of the blow-molded plastic structure from the mold when the blow-molding process is completed. The panel 60 may also include other structures such as the fastener receiving portions 40 and structures that facilitate attachment of the frame 30 and/or the leg assemblies 42, 44 to the table top 12. These types of structures are typically not included or considered when determining the nominal panel thickness PT.

The panel 60 may also have a nominal wall thickness WT, which may be the mean or average measurement of the thickness of the outer wall of the blow-molded plastic structure. For example, the nominal wall thickness WT may be the mean or average thickness of the upper surface 22 and/or the lower surface 24 of the table top 12. It will be appreciated that the nominal wall thickness WT may include localized areas that are larger or smaller. For example, the lower surface 22 may include localized areas of decreased wall thickness WT where the plastic is stretched or deformed to form depressions (which are described in more detail below). The nominal wall thickness WT, however, may not include portions of the table top 12 such as the fastener receiving portions 40, portions 62 and/or portions 64. The nominal wall thickness WT for the blow-molded plastic table top 12 may be less than or generally equal to about 0.05 inches. In particular, the nominal wall thickness WT for the table top 12 may be between about 0.05 inches and about 0.03 inches. For example, the nominal wall thickness WT may be about 0.045 inches, about 0.04 inches, or about 0.035 inches.

As shown in the accompanying figures, the lower surface 24 of the table top 12 may include a plurality of depressions 70. The depressions 70 may be closely spaced and a distance between adjacent depressions may be measured from an edge of one depression to an edge of the adjacent depression. The nominal distance D between adjacent depressions may be mean or average edge-to-edge distance between adjacent depressions. As shown in the accompanying figures, the nominal distance D between adjacent depressions may be generally uniform or consistent. The nominal distance D between adjacent depressions, however, can vary or change.

The nominal distance D between adjacent depressions may be measured along an axis aligned with a center of a plurality of generally aligned depressions. For example, the nominal distance D may be measured between adjacent depressions aligned along a length or width of the table top 12. The nominal distance D may also be measured between adjacent depressions aligned at an angle, such as a diagonal, relative to a side and/or end of the table top 12. Alternatively, the nominal distance D could be the distance to the closest adjacent depression.

In greater detail, the lower surface 24 of table top 12 may include a plurality of depressions 70 and the depressions may be sized and configured to increase the strength and/or structural integrity of the table top. The ends of the depressions 70 may contact or engage the upper surface 22 of the table top 12 and/or the ends of the depressions may be spaced from the upper surface of the table top by a distance. As shown in the accompanying figures, the depressions 70 may cover a majority, substantially all, or the entire lower surface 24 of the table top 12. After reviewing this disclosure, it will be appreciated that the depressions 70 may be disposed in and/or cover any desired portion of the table top 12.

The depressions 70 may be arranged into a predetermined pattern or array, and the pattern may repeat any suitable number of times. The pattern may include one or more depressions 70 disposed in a uniform or consistent arrangement. The depressions 70 disposed in the pattern may be sized and configured to increase the strength and/or structural integrity of the table top 12. The depressions 70 may also be arranged to help create a table top 12 with generally uniform properties and characteristics. For example, closely spacing the depressions 70 over substantially the entire lower surface 24 may allow the table top 12 to have increased strength and generally uniform properties and characteristics.

The depressions 70 may be disposed in a pattern or array that minimizes the nominal distance D between adjacent depressions. Advantageously, minimizing the nominal distance D between adjacent depressions may minimize the unsupported areas of the opposing surface. Minimizing the nominal distance D between adjacent depressions may also increase the structural integrity and strength of the blow-molded plastic structure. In addition, minimizing the nominal distance D between adjacent depressions may increase the smoothness, evenness, and/or flatness of the opposing surface. For instance, the accompanying figures illustrate several exemplary configurations and arrangements of closely spaced depressions 70 and are separated by the nominal distance D. For instance, the lower surface 24 of the table top 12 may include a plurality of closely spaced depressions 70 that are separated by the nominal distance D and that may help create an upper surface 22 with increased smoothness, evenness, and/or flatness.

Advantageously, the smaller nominal distance D between adjacent depressions 70 may increase the structural integrity and strength of the blow-molded plastic structure, which may allow the nominal wall thickness WT of the blow-molded plastic structure to be decreased. Accordingly, less plastic materials may be used to construct blow-molded plastic structures because of the reduced nominal wall thickness WT and that may reduce costs. In addition, the decreased nominal wall thickness WT may allow the blow-molded plastic structures to cool more quickly during the manufacturing process because it may dissipate heat more rapidly. The blow-molded plastic structures may also be removed from the mold more quickly and/or at a higher temperature because, for example, of the increased strength and/or structural integrity. These and other factors may significantly decrease the time required to construct blow-molded plastic structures and it may increase manufacturing efficiency by, for example, decreasing manufacturing cycle time.

As discussed above, one skilled in the art previously thought large (i.e., an area of at least one, two, three, four, five or more square feet) blow-molded plastic structures required opposing surfaces to be spaced apart by significantly more than one-half inch. Large, thin blow-molded plastic structures, however, can be constructed with opposing surfaces spaced apart by one-half inch or less. In addition to the opposing surfaces being separated by one-half inch or less, a plurality of closely spaced depressions 70 can be formed. Significantly, this may allow the nominal wall thickness WT of the large, thin blow-molded plastic to be decreased.

In greater detail, decreasing the distance between the opposing surfaces to one-half inch or less, increasing the number of depressions 70, and decreasing the nominal distance D between adjacent depressions provides the surprising and unexpected result that large, thin blow-molded plastic structures can be constructed. Specifically, it was previously thought that the distance between opposing surfaces had to be significantly more than one-half inch when constructing large blow-molded plastic structures. Decreasing the distance between opposing surfaces to one-half inch or significantly less than one-half inch, however, allows the nominal wall thickness WT to be decreased and allows the nominal distance D between adjacent depressions to be decreased. Additionally, large, thin blow-molded plastic structures with a thickness of less than one-half inch may have considerable stiffness, rigidity and structural integrity, despite the fact that these surfaces are separated by a distance that is considerably less than one-half inch.

The relationship between the nominal wall thickness WT, nominal panel thickness PT, and nominal edge-to-edge distance between adjacent depressions D for large, thin blow-molded plastic structures is shown in the following equation:

$$WT \cdot PT \cdot D \leq 0.030$$

For example, if the nominal wall thickness WT is about 0.04 inches, the nominal panel thickness PT is about 0.5 inches, and the nominal distance D between adjacent depressions is about 0.7 inches, the result is 0.014, which is less than 0.030. In an exemplary embodiment, as the nominal wall thickness WT decreases, the nominal distance D between adjacent depressions may decrease.

Advantageously, a significant reduction in weight may occur for structures that satisfy the above equation. For example, a known table top with a 0.05 inch WT, a 0.7 inch PT, and a 1.0 inch D may have a weight of about 5 pounds. This known table top does not satisfy the above equation because (0.05)(0.7)(1.0)=0.035. An embodiment of a table top with a similar size that satisfies the above equation, however, may have a significant reduction in weight. For instance, an exemplary embodiment of a table top may have a nominal wall thickness WT of about 0.04 inch, a nominal panel thickness PT of about 0.5 inch, and a nominal distance D between adjacent depressions of about 0.7 inch. This exemplary table top satisfies the above equation because (0.04)(0.5)(0.7)=0.014 and has a weight of about 3 pounds, which is significant reduction from the known table top that has a weight of about 5 pounds. Thus, a forty percent (40%) weight reduction may be achieved if the above equation is satisfied in comparison to conventional table tops of the same size. In addition, table tops that satisfy the above equation may reduce manufacturing cycle time by about ten percent (10%) or more because, among other reasons, less plastic materials may be used and heat may be dissipated more rapidly. Further, table tops that satisfy this equation may have a thinner profile because the height of the table top may be decreased.

Advantageously, structures that satisfy this equation and have closely spaced depressions 70 arranged into a predetermined pattern may create high-strength, lightweight structures with generally uniform properties and/or characteristics. In addition, if the depressions 70 are arranged into a pattern with generally constant and uniform spacing, even if other features, objects or items are formed in the structure, the structure may have generally uniform properties and/or characteristics. If desired, one or more depressions 70 may be formed in the other features, objects or items to maintain a generally uniform and consistent pattern. Thus, the depressions 70 may be spaced so that the distance between adjacent depressions is minimized, at least substantially the entire surface is covered with depressions, and the depressions may be disposed in a generally uniform and consistent pattern even if other features, objects or items are formed in the blow-molded plastic structure.

In order to obtain a generally uniform and consistent pattern of depressions 70, it may be desired to eliminate or minimize other features, objects or items formed in the blow-molded structure. If desired, the generally uniform and consistent pattern of depressions 70 may be disposed in, about, and/or around these features, objects and items.

The depressions 70 may be sized and configured to allow the depressions to be closely spaced. For example, one or more sidewalls 72 of the depressions 70 may be disposed at a relatively steep angle to allow the depressions to be closely spaced. In an exemplary embodiment, the sidewalls 72 of the depressions 70 may be disposed at an angle between about sixty degrees (60°) and about eight-five degrees (85°) relative to the lower surface 24 of the table top 12. The sidewalls 72 may also be positioned at an angle of about seventy-five degrees (75°) or more with respect to the lower surface 24 of the table top 12. It will be appreciated that the sidewalls 72 may be positioned at any desired angle relative to the lower surface 24 of the table top 12 depending, for example, upon the size and configuration of the depressions 70.

The table top 12 illustrates the depressions 70 may be disposed in one or more exemplary patterns. For example, as shown in the accompanying figures, the depressions 70 may be disposed in a first pattern 74, a second pattern 76, a third pattern 78, and a fourth pattern 80. The patterns 74, 76, 78, and 80 may be symmetrically disposed on each side of the table top 12. For readability and convenience, only one side of the table top 12 will be discussed below in detail because the other side may be the same or a mirror image. It will be appreciated, however, that the table top 12 does not have to be symmetrical and the table top could include any suitable number, size, shape, configuration and arrangement of depressions and/or patterns.

Figure 6:
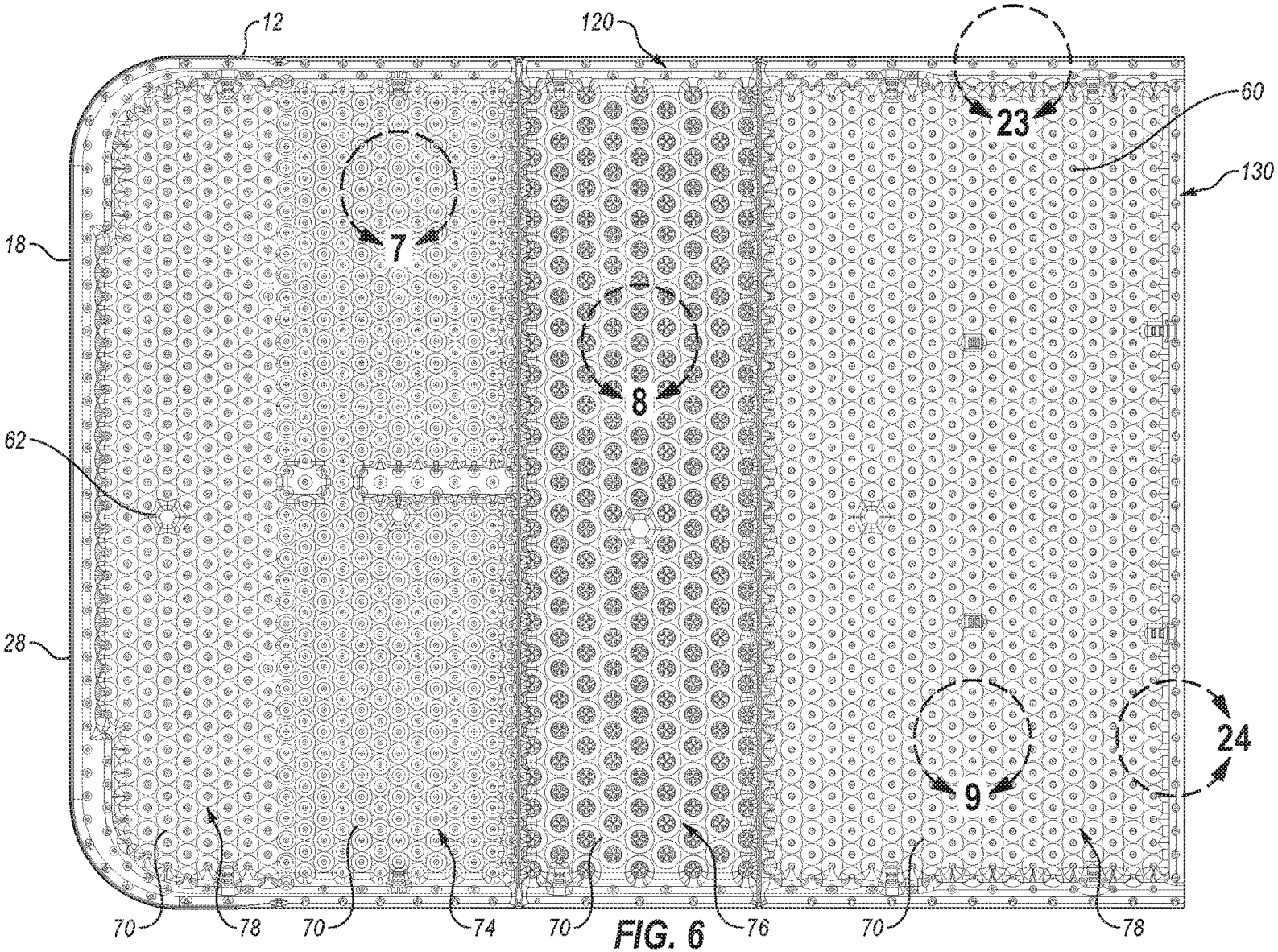
FIG. 6 is a bottom view of the portion of the table top shown in FIG. 5.

The patterns 74, 76, 78, and 80 may include depressions 70 with different sizes, shapes, configurations and/or arrangements. For example, the depressions 70 may have different sized openings and/or ends. The depressions 70 may also have different configurations such as sidewalls 72 disposed at different angles and ends with multiple engagement surfaces. Exemplary embodiments of the patterns are shown in FIGS. 4-6 (patterns 74, 76, and 78) and FIGS. 15-19 (pattern 80). For readability, all of the depressions are generally identified as depressions 70 even though the depressions may have different sizes, shapes, configurations and arrangements. It will be appreciated, after reviewing this disclosure, that any number and configuration of patterns and depressions may be utilized depending, for example, upon the intended use of the blow-molded plastic structure.

Figure 7:
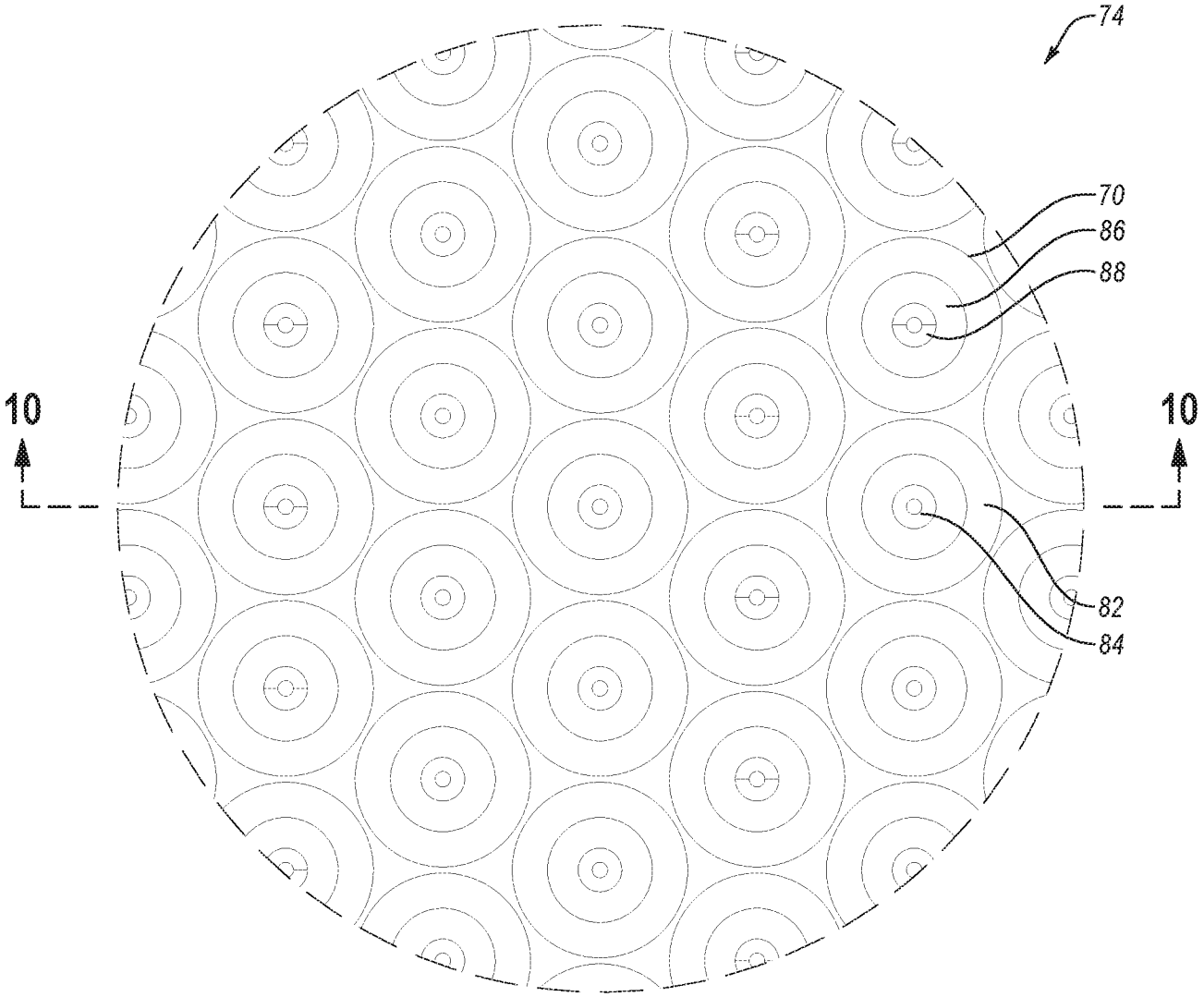
FIG. 7 is an enlarged bottom view of a portion of the table top shown in FIG. 6, identified by a broken line and number 7 in FIG. 6.
Figure 10:
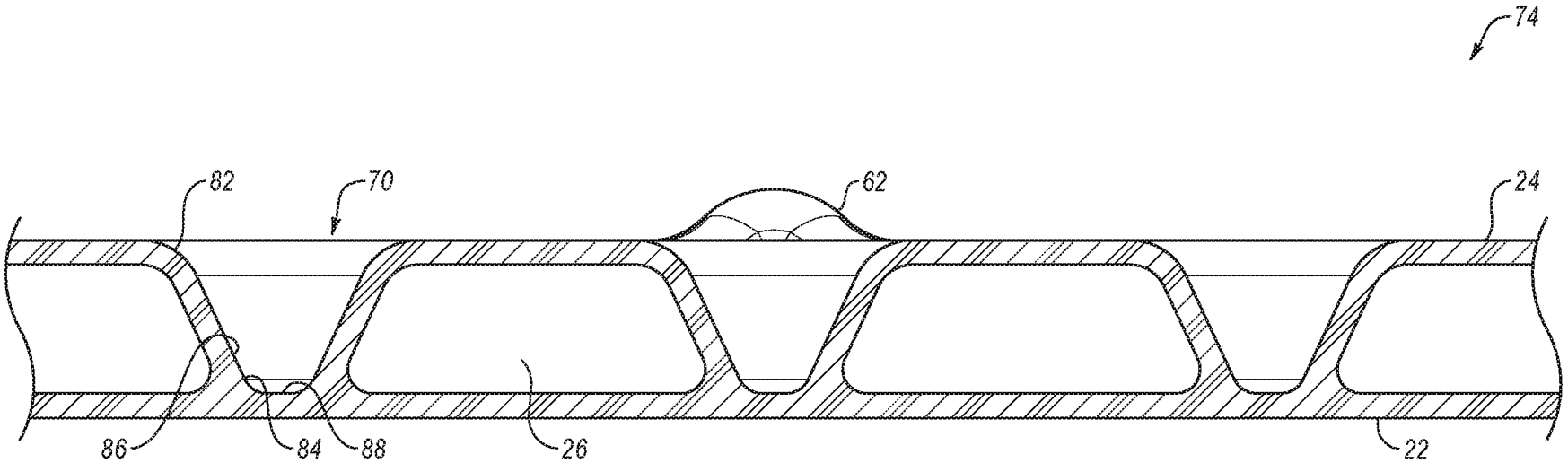
FIG. 10 is an enlarged cross-sectional side view of a portion of the table top shown by lines 10-10 in FIG. 7.

As seen in FIGS. 6, 7, and 10, the first pattern 74 of depressions 70 may be disposed towards the first end 18 of the table top 12 and the depressions may have a generally circular configuration with a first portion 82, a second portion 84, and a sidewall 86. The first portion 82 of the depression 70 may have a diameter between about 0.30 inches and about 0.80 inches, such as between about 0.40 inches and about 0.67 inches (e.g., measured at wider and narrower parts). The second portion 84 of the depression 70 may have a diameter between about 0.03 inches and about 0.20 inches, such as between about 0.06 inches and about 0.17 inches (e.g., measured at wider and narrower parts). The sidewall 86 of the depression 70 may be disposed between an angle of about seventy degrees (70°) and about sixty degrees (60°), such as about sixty-five degrees (65°) relative to the lower surface 24 of the table top 12. The first pattern 74 may have a nominal panel thickness PT between about 0.40 inches and about 0.50 inches, such as about 0.435 inches (the distance between an upper portion of the upper surface and a lower portion of the lower surface); or a nominal panel thickness between about 0.30 and about 0.40 inches, such as about 0.375 inches (the distance between an inner portion of the upper surface and an inner portion of the lower surface). The first pattern 74 may have a nominal wall thickness WT between about 0.03 inches and about 0.05 inches, such as about 0.04 inches. The first panel may have a nominal distance D between adjacent depressions between about 0.50 inches and about 0.60 inches, such as about 0.54 inches. Thus, the above equation for the first pattern 74 of depressions 70 is (0.04)(0.435)(0.54)=0.01, which is less than 0.030. Thus, the first pattern 74 satisfies the above equation.

In greater detail, as best seen in FIGS. 7 and 10, the depressions 70 of the first pattern 74 of depressions may include an engagement surface 88 and the engagement surface may engage the upper surface 22 of the table top 12. The engagement surface 88 may support the upper surface 22 of the table top 12 and may help create a table top with generally uniform properties and characteristics.

Figure 8:
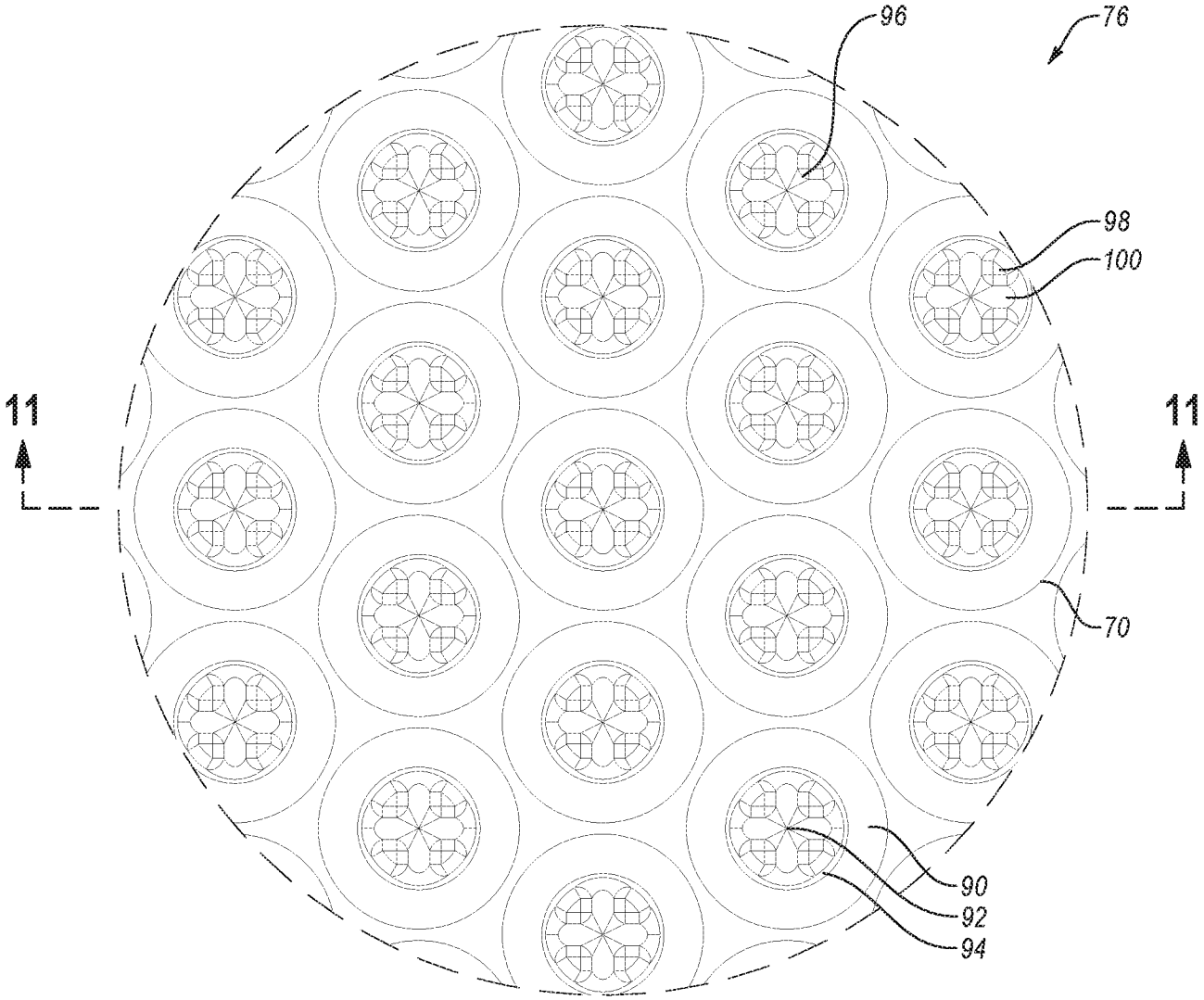
FIG. 8 is an enlarged bottom view of a portion of the table top shown in FIG. 6, identified by a broken line and the number 8 in FIG. 6.
Figure 11:
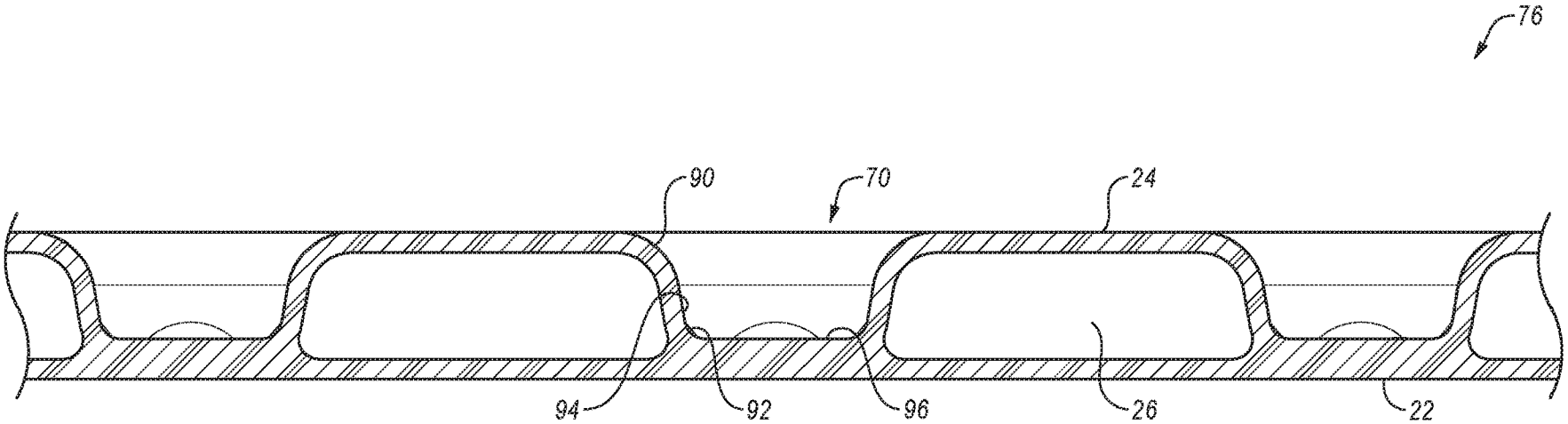
FIG. 11 is an enlarged cross-sectional side view of a portion of the table top shown by lines 11-11 in FIG. 8.

As seen in FIGS. 6, 8, and 11, the second pattern 76 of depressions 70 may be disposed adjacent to the first pattern 74 of depressions and the depressions may have a generally circular configuration with a first portion 90, a second portion 92, and a sidewall 94. The first portion 90 of the depressions 70 may have a diameter between about 1.0 inches and about 0.90 inches, such as about 0.95 inches at a wider part. The first portion 90 of the depression 70 may have a diameter between about 0.50 and about 0.70 inches, such as about 0.58 inches at a narrower part. The upper portion 92 of the depression 70 may have a diameter between about 0.60 inches and about 0.50 inches, such as between about 0.54 inches at a wider part. The upper portion 92 of the depression 70 may have a diameter between about 0.40 inches and about 0.50 inches, such as about 0.42 inches at a narrower part. The sidewall 94 of the depression 70 may be disposed between an angle of about eighty-five degrees (85°) and about seventy degrees (70°), such as about eighty degrees (80°) relative to the lower surface 24 and/or upper surface 22 of the table top 12. The second pattern 76 may have a nominal panel thickness PT between about 0.40 inches and about 0.50 inches, such as about 0.435 inches (the distance between an upper portion of the upper surface and a lower portion of the lower surface); or a nominal panel thickness between about 0.30 and about 0.40 inches, such as about 0.375 inches (the distance between an inner portion of the upper surface and an inner portion of the lower surface). The second pattern 76 may have a nominal wall thickness WT between about 0.03 inches and about 0.05 inches, such as about 0.04 inches. The second pattern 76 may have a nominal distance D between adjacent depressions between about 0.7 inches and about 0.9 inches, such as about 0.78 inches. Thus, the above equation for the second pattern 76 of depressions 70 is (0.04)(0.435)(0.78)=0.013, which is less than 0.030 and this pattern satisfies the above equation.

As best seen in FIGS. 8 and 11, the depressions 70 of the second pattern 76 of depressions 70 may include an engagement surface 96 and the engagement surface may engage the upper surface 22 of the table top 12. The engagement surface 96 may support the upper surface 22 of the table top 12 and may help create a table top with generally uniform properties and characteristics. As seen in FIG. 8, the engagement surface 96 may include one or more engaging portions 98 and one or more conduits or pathways 100. For example, the engagement surface 96 may include four engaging portions 98 and four pathways 100. The engaging portions 98 may be sized and configured engage and/or support the upper surface 22 of the table top 12 and the pathways 100 may be sized and configured to facilitate gas flow during the blow-molding process. In particular, the engaging portions 98 and the pathways 100 may allow increased gas flow during the blow-molding process, which may facilitate construction of the blow-molded plastic structure.

Figure 9:
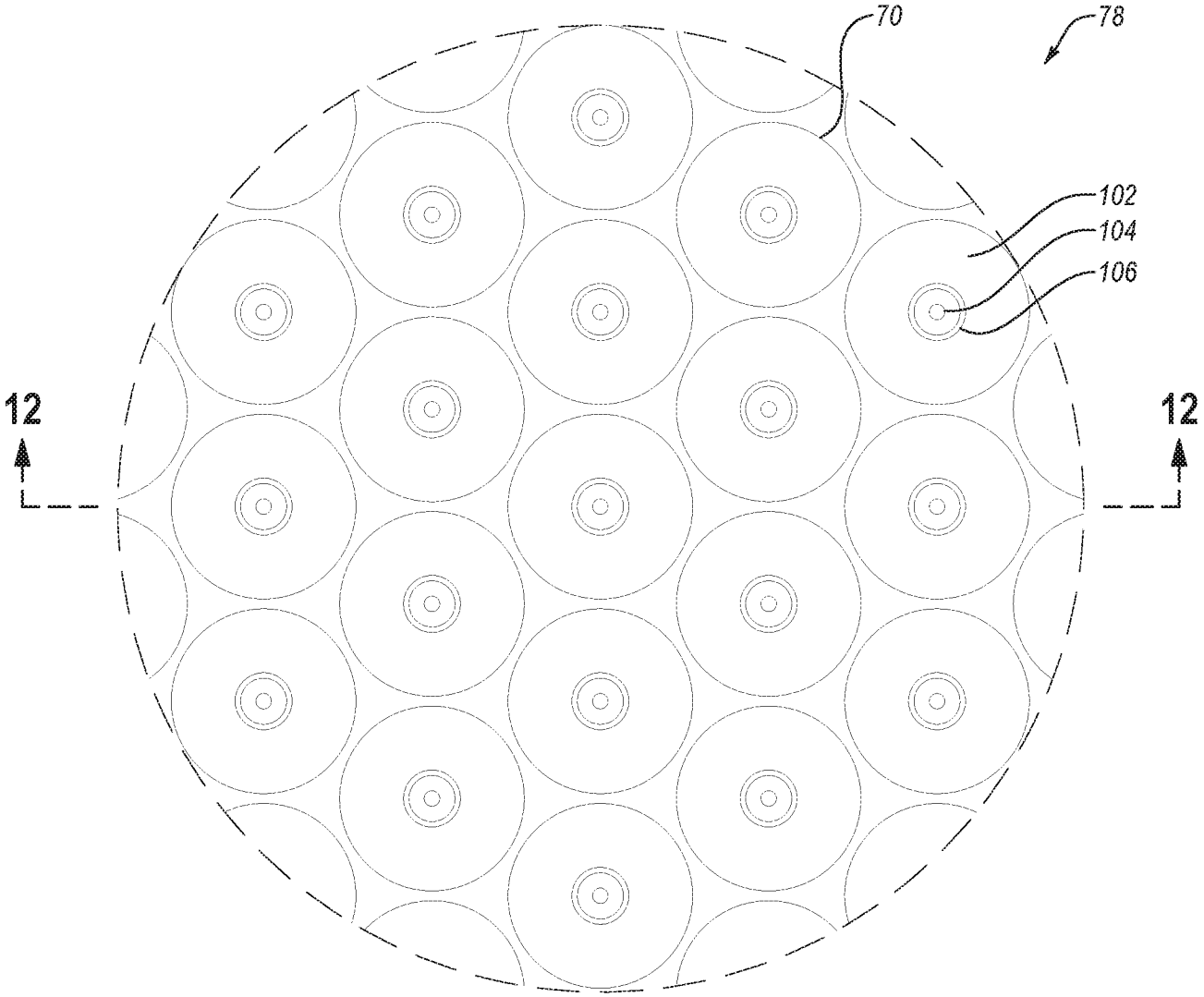
FIG. 9 is an enlarged bottom view of a portion of the table top shown in FIG. 6, identified by a broken line and the number 9 in FIG. 6.
Figure 12:
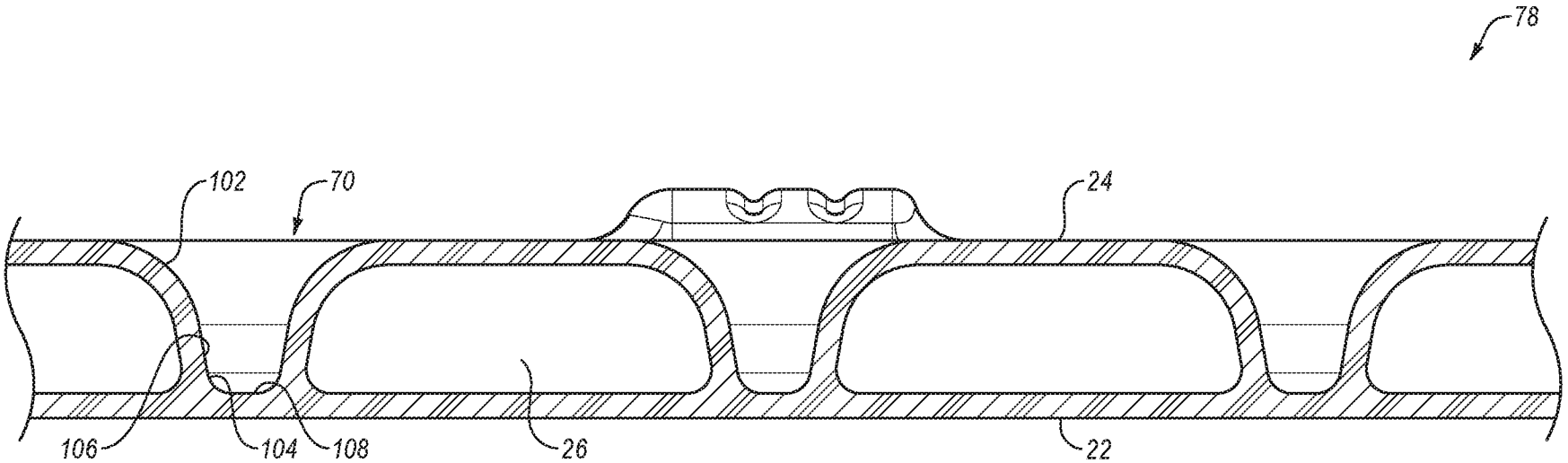
FIG. 12 is an enlarged cross-sectional side view of a portion of the table top shown by lines 12-12 in FIG. 9.
Figure 13:
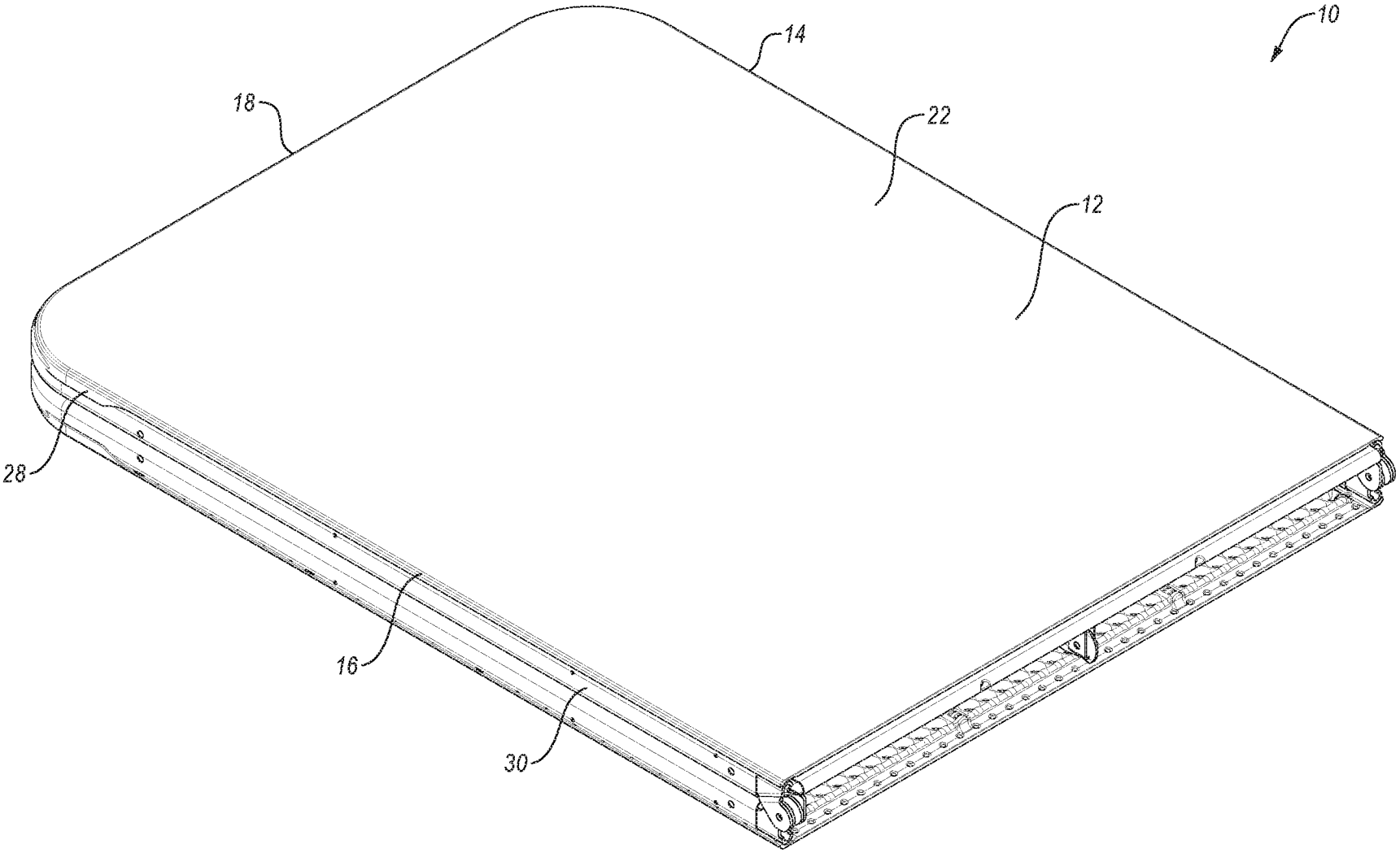
FIG. 13 is an upper perspective view of another exemplary embodiment of a table, illustrating the table as a fold-in-half table in the collapsed position and including a table top comprising large, thin, generally planar blow-molded plastic structure with a nominal thickness generally equal to or less than one-half inch.
Figure 14:
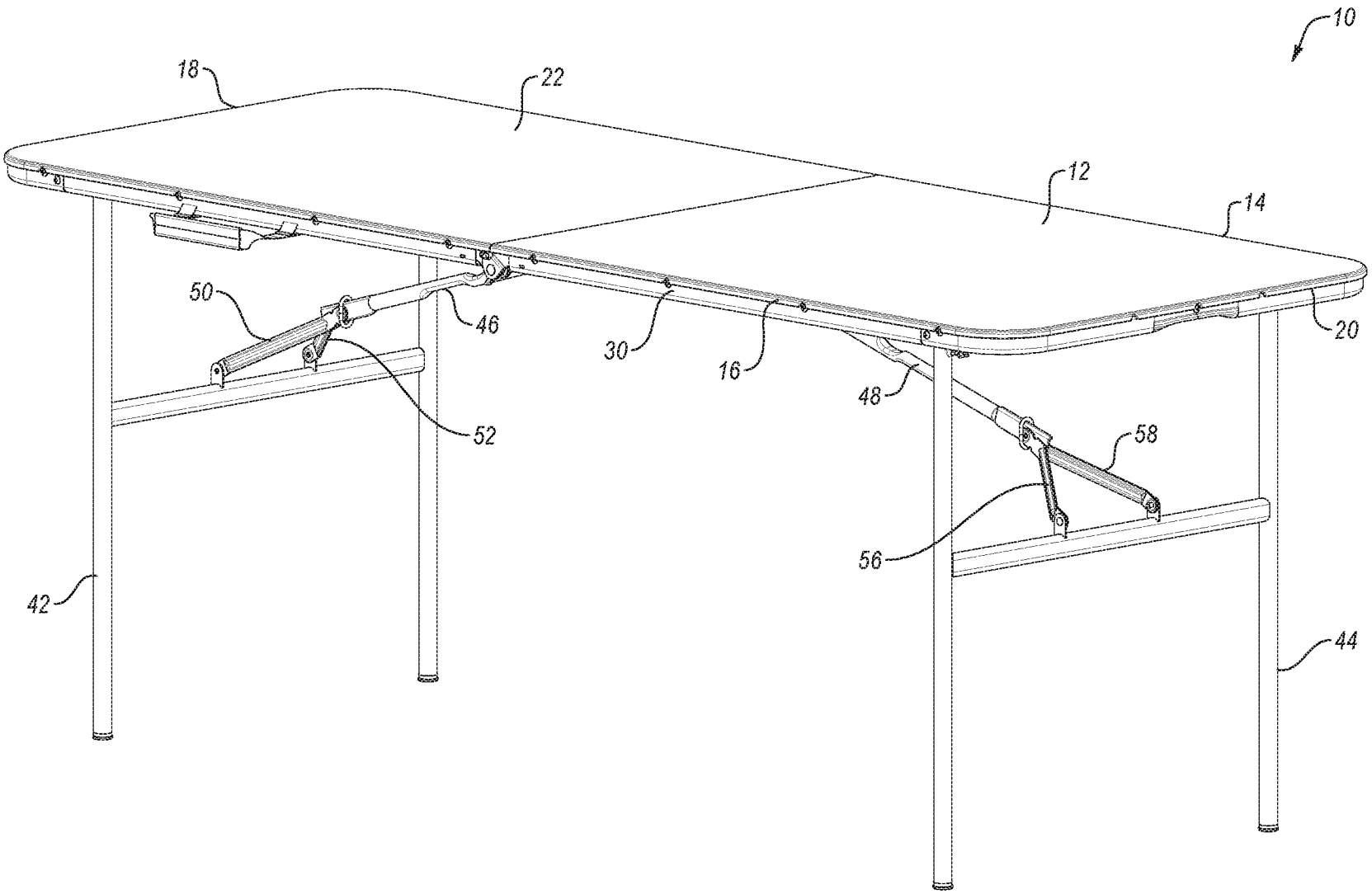
FIG. 14 is an upper perspective view of another exemplary embodiment of a table, illustrating the table in a use position with the table legs in an extended position and including a table top comprising large, thin, generally planar blow-molded plastic structure with a nominal thickness generally equal to or less than one-half inch.
Figure 15:
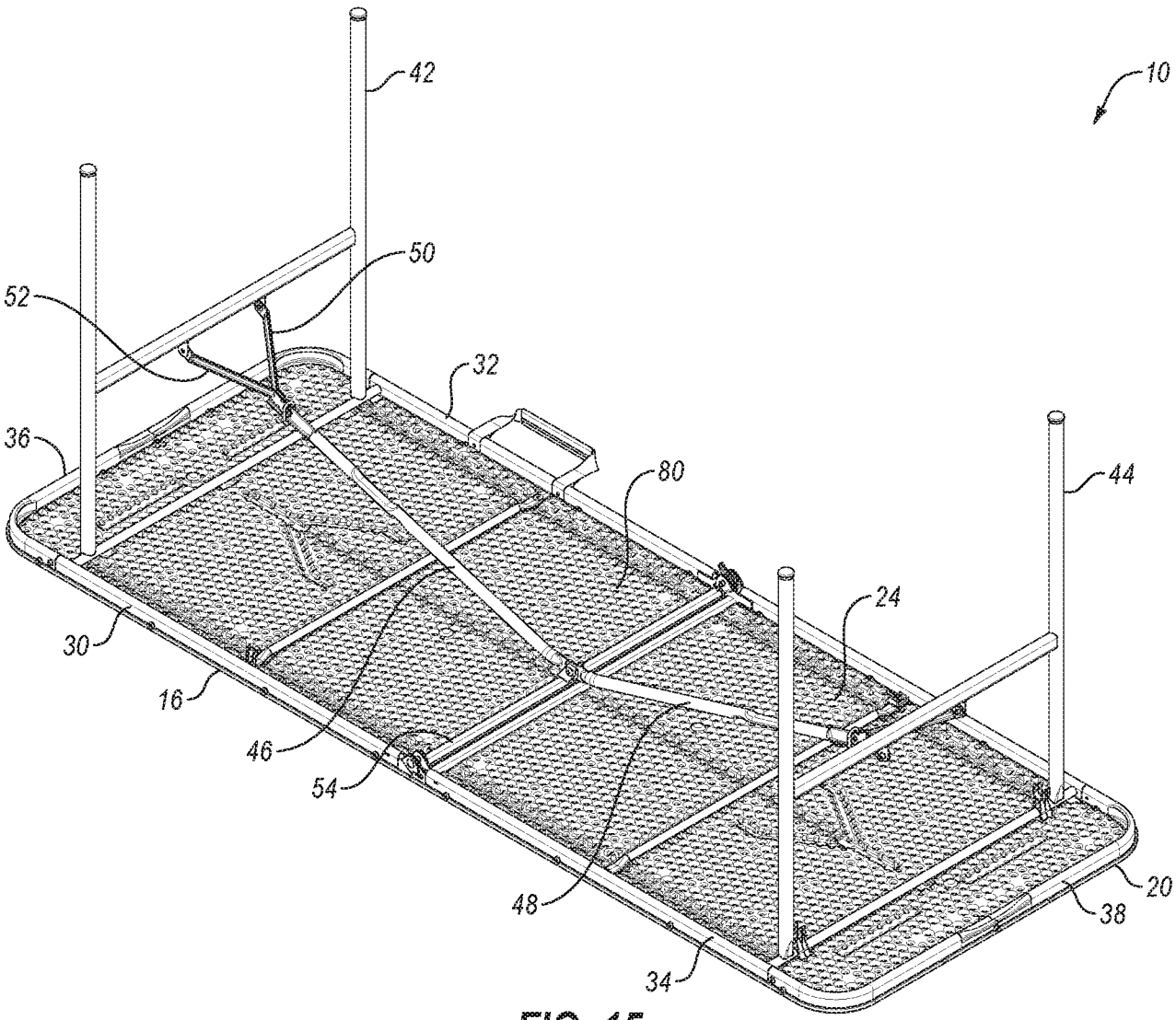
FIG. 15 is a lower perspective view of the table shown in FIG. 14.
Figure 16:
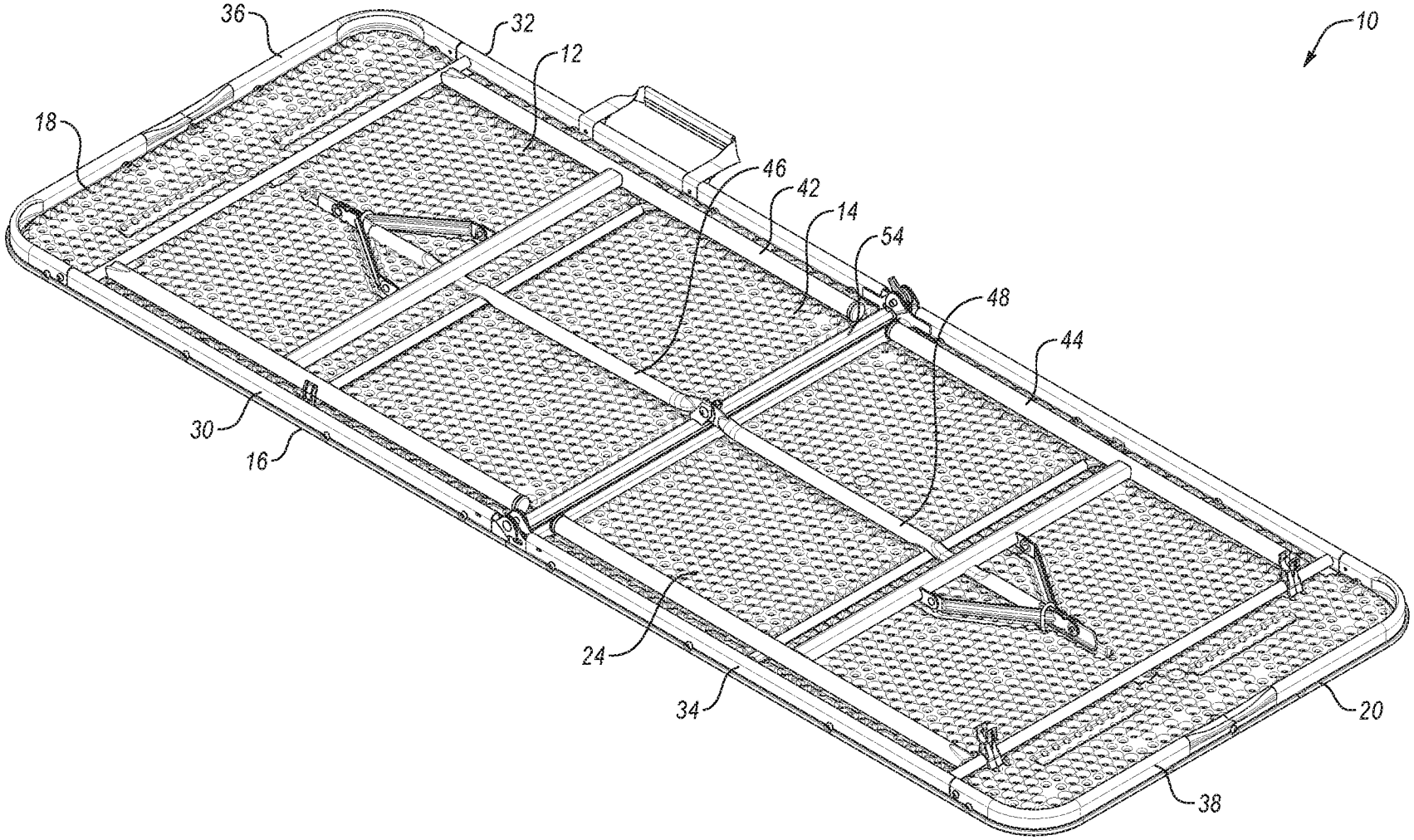
FIG. 16 is a lower perspective view of the table shown in FIG. 14, illustrating the table legs in a collapsed position.
Figure 17:
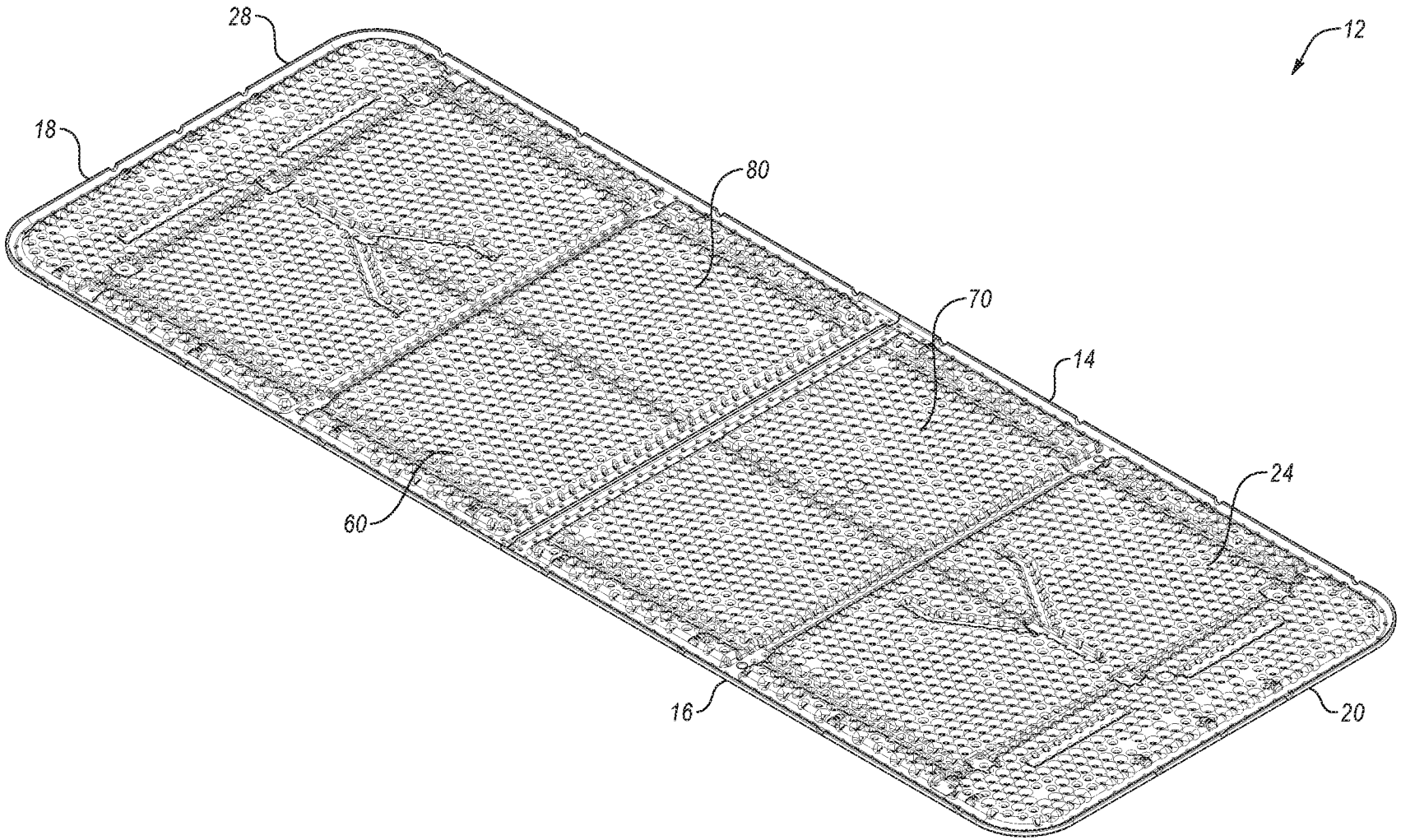
FIG. 17 is a lower perspective view of a portion of the table shown in FIG. 14, showing the table top.
Figure 18:
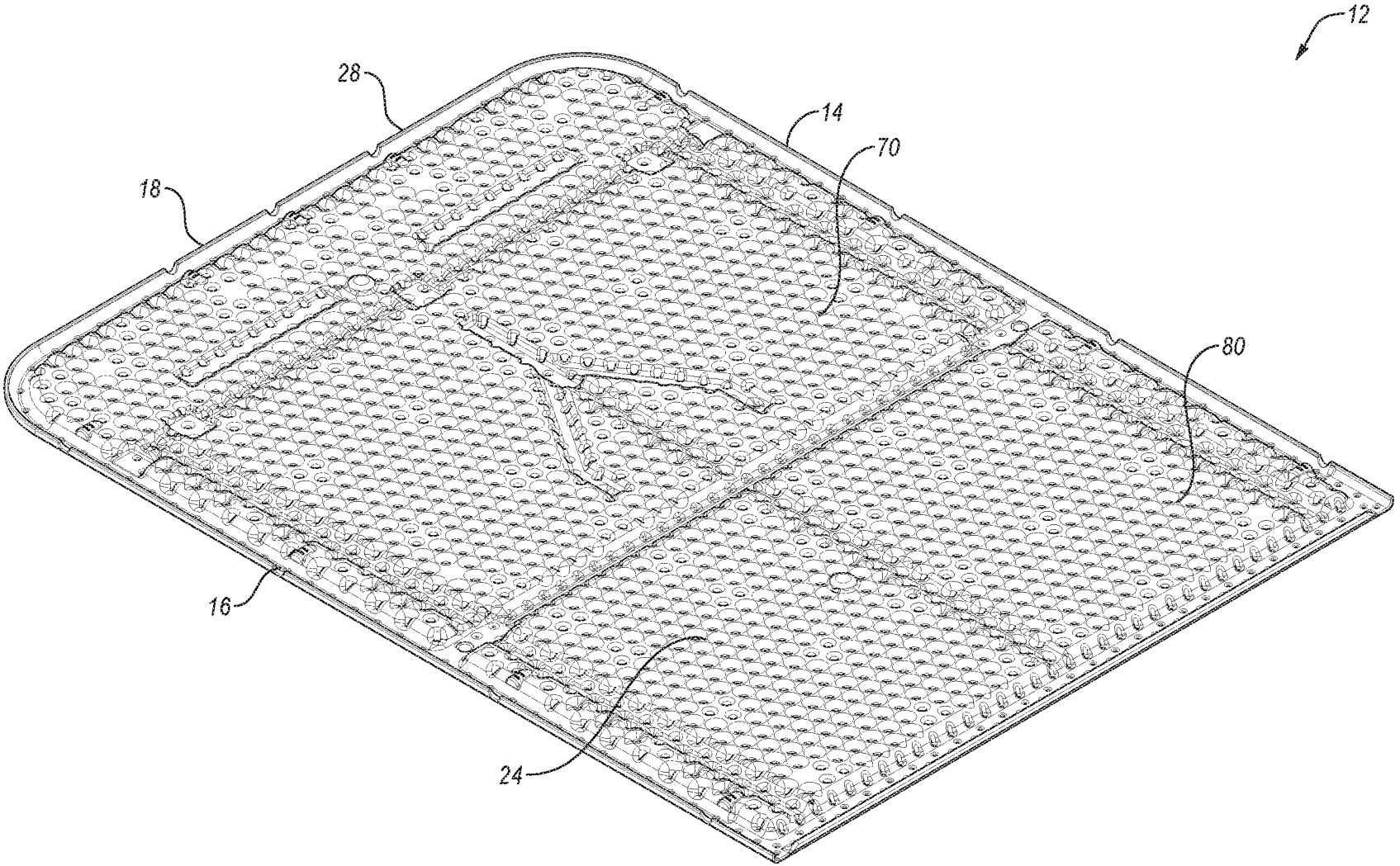
FIG. 18 is an enlarged lower perspective view of a portion of the table top shown in FIG. 17.

The third pattern 78 of depressions 70 may be disposed in multiple sections of the table top 12, such as proximate a center portion of the table top and proximate the first end 18 of the table top. As seen in FIGS. 6, 9, and 12, the third pattern 78 if depressions 70 may have a generally circular configuration with a first portion 102, a second portion 104, and a sidewall 106. The lower portion 102 of the depressions may have a diameter between about 0.60 inches and about 0.80 inches, such as about 0.71 inches at wider part. The lower portion 102 if the depressions 70 may have a diameter between about 0.20 inches and about 0.3 inches, such as about 0.22 inches at narrower part. The upper portion 104 of the depression 70 may have a diameter between about 0.10 inches and about 0.20 inches, such as about 0.18 inches at a wider part. The upper portion 104 of the depression 70 may have a diameter between about 0.05 inches and about 0.10 inches, such as about 0.06 inches at a narrower part. The sidewall 106 of the depression 70 may be disposed between an angle of about seventy-five degrees (75°) and about eighty-five degrees (85°), such as about eighty degrees (80°) relative to the lower surface 24 of the table top 12. The third pattern 78 may have a nominal panel thickness PT between about 0.40 inches and about 0.50 inches, such as about 0.435 inches (the distance between an upper portion of the upper surface and a lower portion of the lower surface); or a nominal panel thickness between about 0.30 and about 0.40 inches, such as about 0.375 inches (the distance between an inner portion of the upper surface and an inner portion of the lower surface). The third pattern 78 may have a nominal wall thickness WT between about 0.03 inches and about 0.05 inches, such as about 0.04 inches. The third pattern 78 may have a nominal distance D between adjacent depressions between about 0.5 inches and about 0.7 inches, such as about 0.59 inches. Thus, the above equation for the third pattern 78 of depressions 70 is (0.04)(0.435)(0.59)=0.010, which is less than 0.030 and the third pattern satisfies the above equation.

As best seen in FIGS. 9 and 12, the depressions 70 of the third pattern 78 of depressions 70 may include an engagement surface 108 and the engagement surface may engage the upper surface 22 of the table top 12. The engagement surface 108 may support the upper surface 22 of the table top 12 and may help create a table top with generally uniform properties and characteristics.

Different sections of the table top 12 may include different patterns of depressions depending, for example, upon the intended use of the table 10. For instance, the first end 18 and center portion of the table top 12 may have the same pattern of depressions so that these portions of the table top have similar properties and characteristics. Other portions of the table top 12 may include different patterns because it may be desirable for different portions of the table top to have different properties and characteristics. For example, one pattern may provide increased strength, rigidity, torsion resistance, and/or the like, which may be beneficial for certain portions of the table top. It may be desirable for other portions of the table top to have different properties or characteristics such as a smoother, more even, or flatter surface. Accordingly, after reviewing this disclosure, one skilled in the art will understand that different portions of the blow-molded plastic structure may have different patterns of depressions.

The table top 12 can also include the fourth pattern 80 and, as shown in FIGS. 15-21, the depressions 70 may cover substantially all of the lower surface 24 of the table top 12. The depressions 70 in the fourth pattern 80 may have a generally circular configuration with a first portion 110, a second portion 112, and a sidewall 114. The first portion 110 of the depression 70 may have a diameter between about 0.60 inches and about 0.80 inches, such as about 0.71 inches at a wider part. The first portion 110 of the depression 70 may have a diameter between about 0.20 and about 0.30 inches, such as about 0.25 inches at a narrower part. The second portion 112 of the depression 70 may have a diameter between about 0.10 inches and about 0.20 inches, such as about 0.17 inches at a wider part; and a diameter between about 0.05 inches and about 0.10 inches, such as about 0.06 inches at a narrower part. The sidewall 114 of the depressions 70 may be disposed between an angle of about seventy-five degrees (75°) and about eight-five degrees (85°), such as about eighty degrees (80°) relative to the lower surface 24 of the table top 12. The fourth pattern 80 may have a nominal panel thickness PT between about 0.40 inches and about 0.60 inches, such as about 0.50 inches (the distance between an upper portion of the upper surface and a lower portion of the lower surface); or a nominal panel thickness between about 0.40 and about 0.50 inches, such as about 0.44 inches (the distance between an inner portion of the upper surface and an inner portion of the lower surface). The fourth pattern 80 may have a nominal wall thickness WT between about 0.03 inches and about 0.05 inches, such as about 0.04 inches. The fourth pattern 80 may have a nominal distance D between adjacent depressions between about 0.5 inches and about 0.7 inches, such as about 0.59 inches. Thus, the above equation for the fourth pattern 80 of depressions 70 is (0.04)(0.50)(0.59)=0.012, which is less than 0.030 and the fourth pattern satisfies the above equation.

Figure 19:
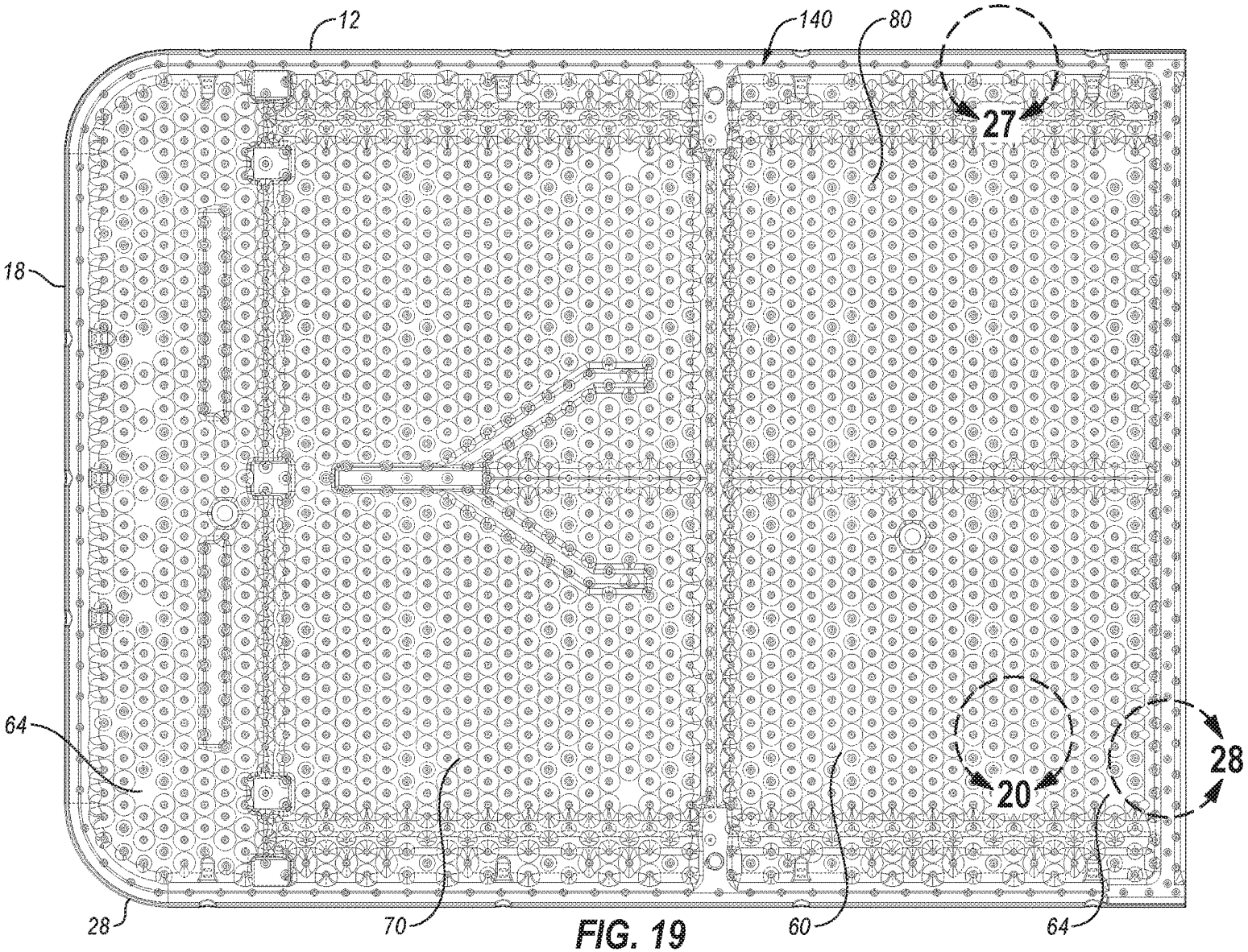
FIG. 19 is a bottom view of the portion of the table top shown in FIG. 18.
Figure 20:
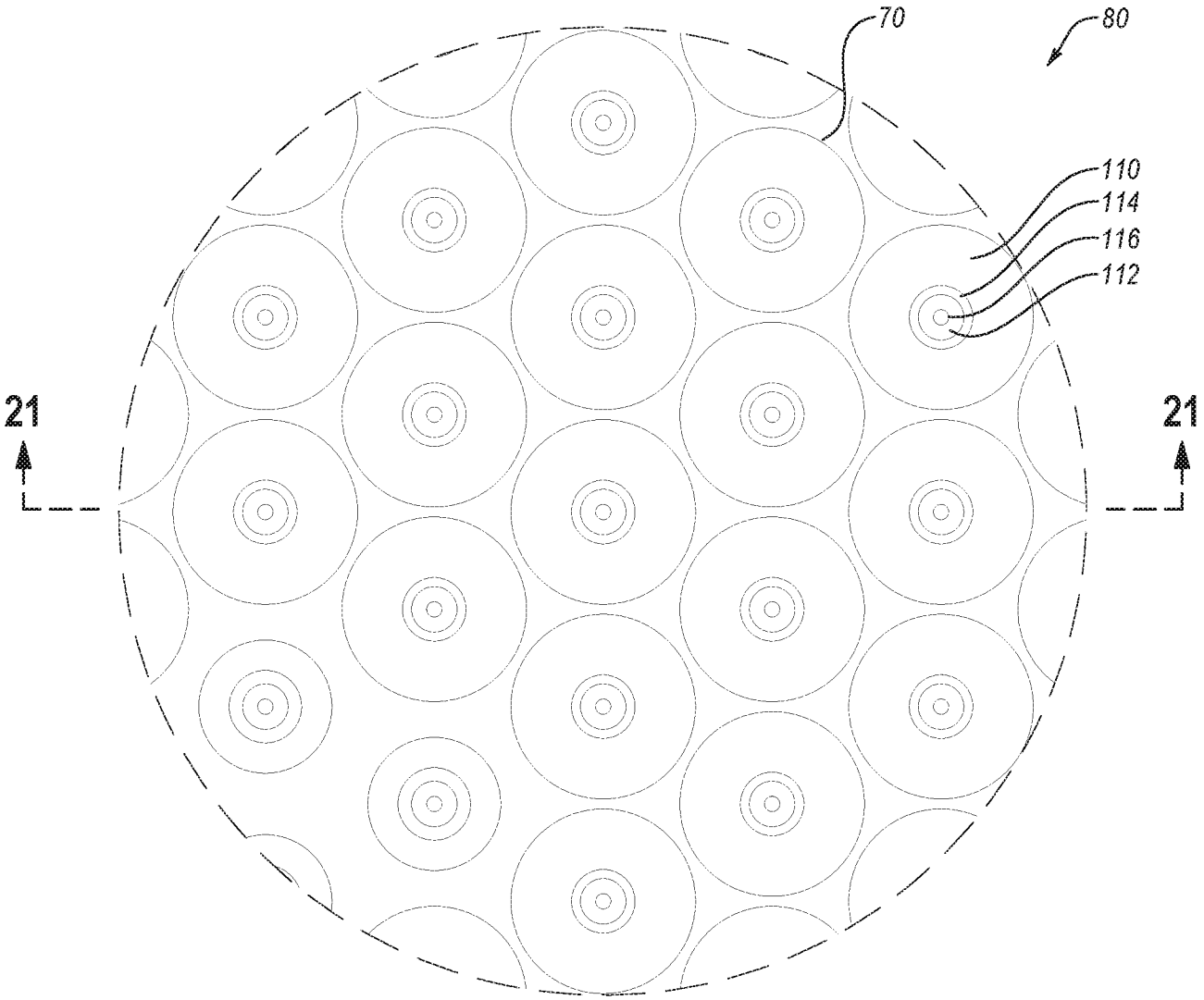
FIG. 20 is an enlarged bottom view of a portion of the table top shown in FIG. 19, identified by a broken line and the number 20 in FIG. 19.
Figure 21:
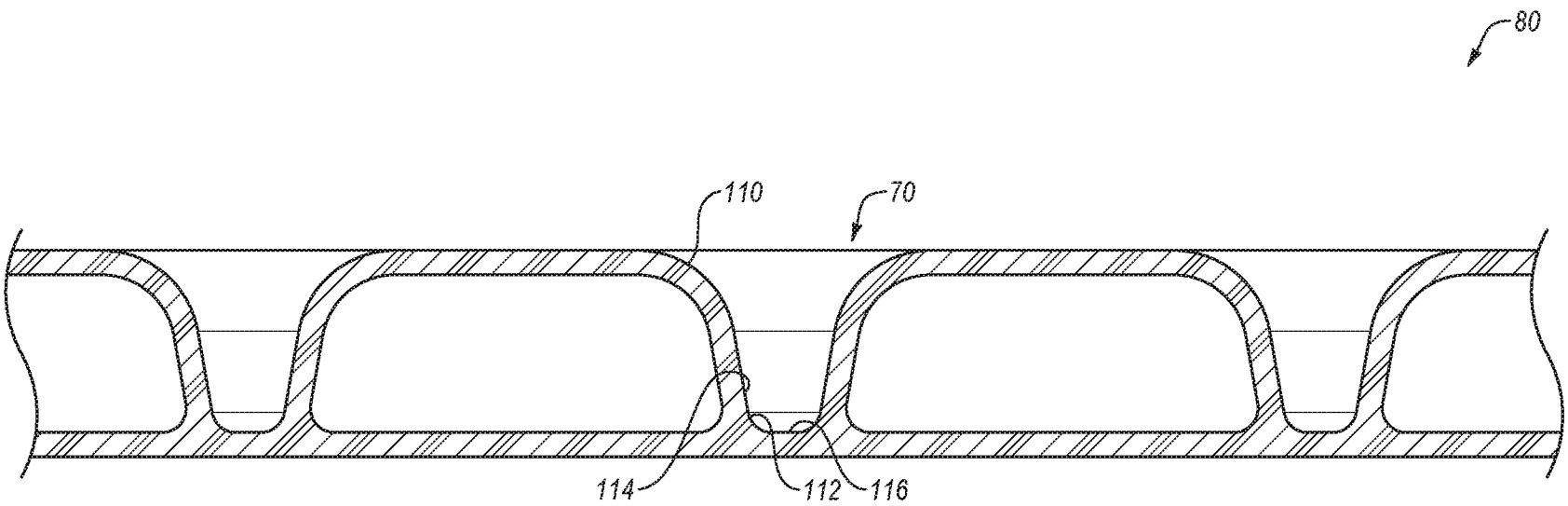
FIG. 21 is an enlarged cross-sectional side view of a portion of the table top shown by lines 21-21 in FIG. 20.
Figure 22:
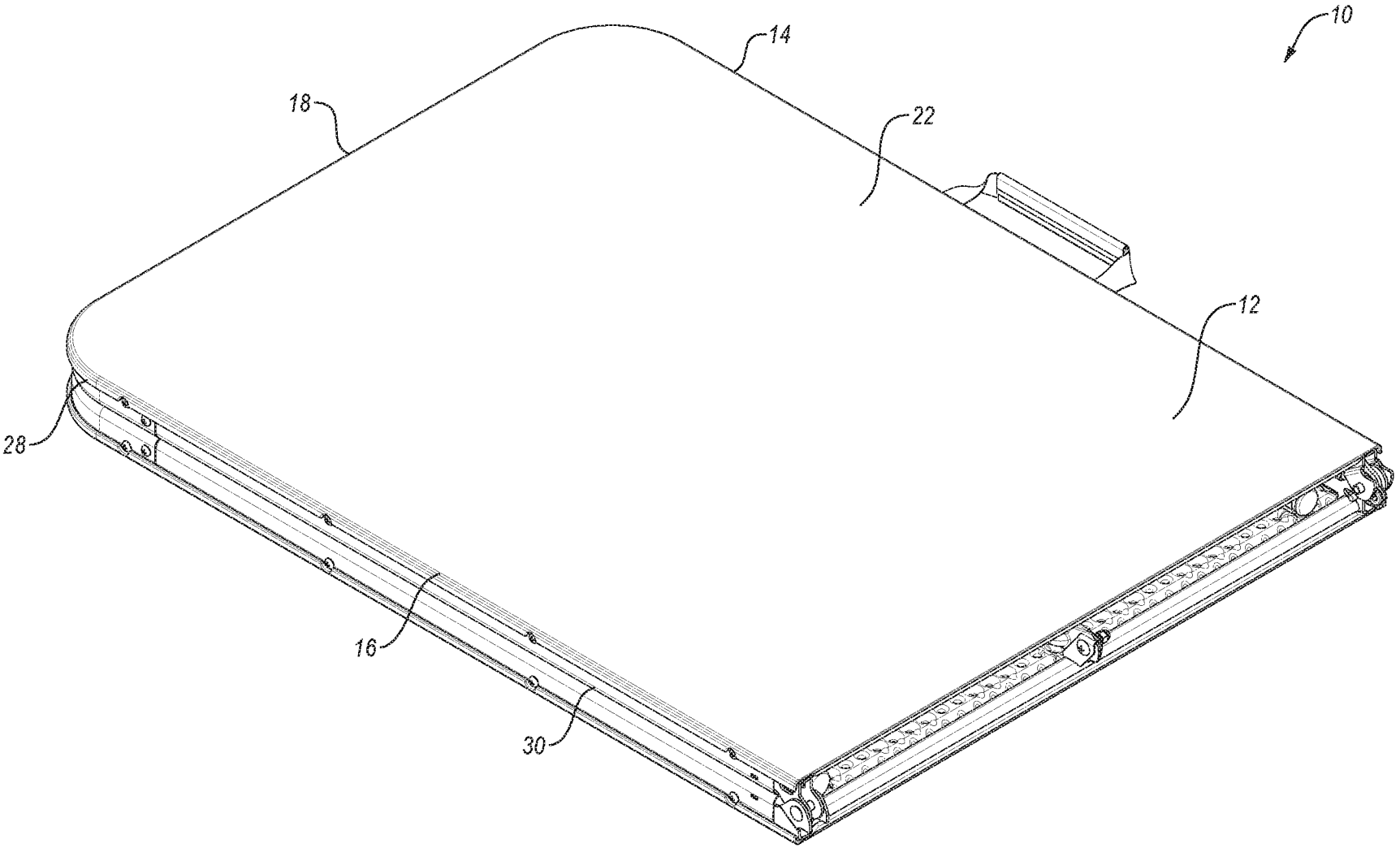
FIG. 22 is an upper perspective view of another exemplary embodiment of a table, the table illustrated as a fold-in-half table that is shown in the collapsed position and including a table top comprising large, thin, generally planar blow-molded plastic structure with a nominal thickness generally equal to or less than one-half inch.

As best seen in FIGS. 19-21, the depressions 70 of the fourth pattern 80 of depressions may include an engagement surface 116 and the engagement surface may engage the upper surface 22 of the table top 12. The engagement surface 116 may support the upper surface 22 of the table top 12 and may help create a table top with generally uniform properties and characteristics.

In view of the above-disclosure, one skilled in the art will appreciate that a large, thin blow-molded plastic structure, such as a table top 12, may be constructed with one or more patterns of depressions. The patterns may be repeating and the depressions in the patterns may have generally uniform size, shape, configuration, and arrangement, which may allow the structure to have generally uniform properties and characteristics.

The table top 12 may also include other portions such as one or more frame receiving portions 120 that are sized and configured to receive portions of the frame 30. The frame receiving portions 120, which may be best seen in FIGS. 6, 19, and 23-30, may be disposed about an outer perimeter of the table top 12. The frame receiving portions 120 may have a reduced thickness in comparison to the thickness of the table top 12 and the frame receiving portions may be disposed adjacent and/or be at least partially formed or defined by the lip 28. In addition, one or more depressions 70 may be disposed in the frame receiving portions 120 and the depressions may help support the upper surface 22 of the table top 12 disposed above the frame 30.

Figure 23:
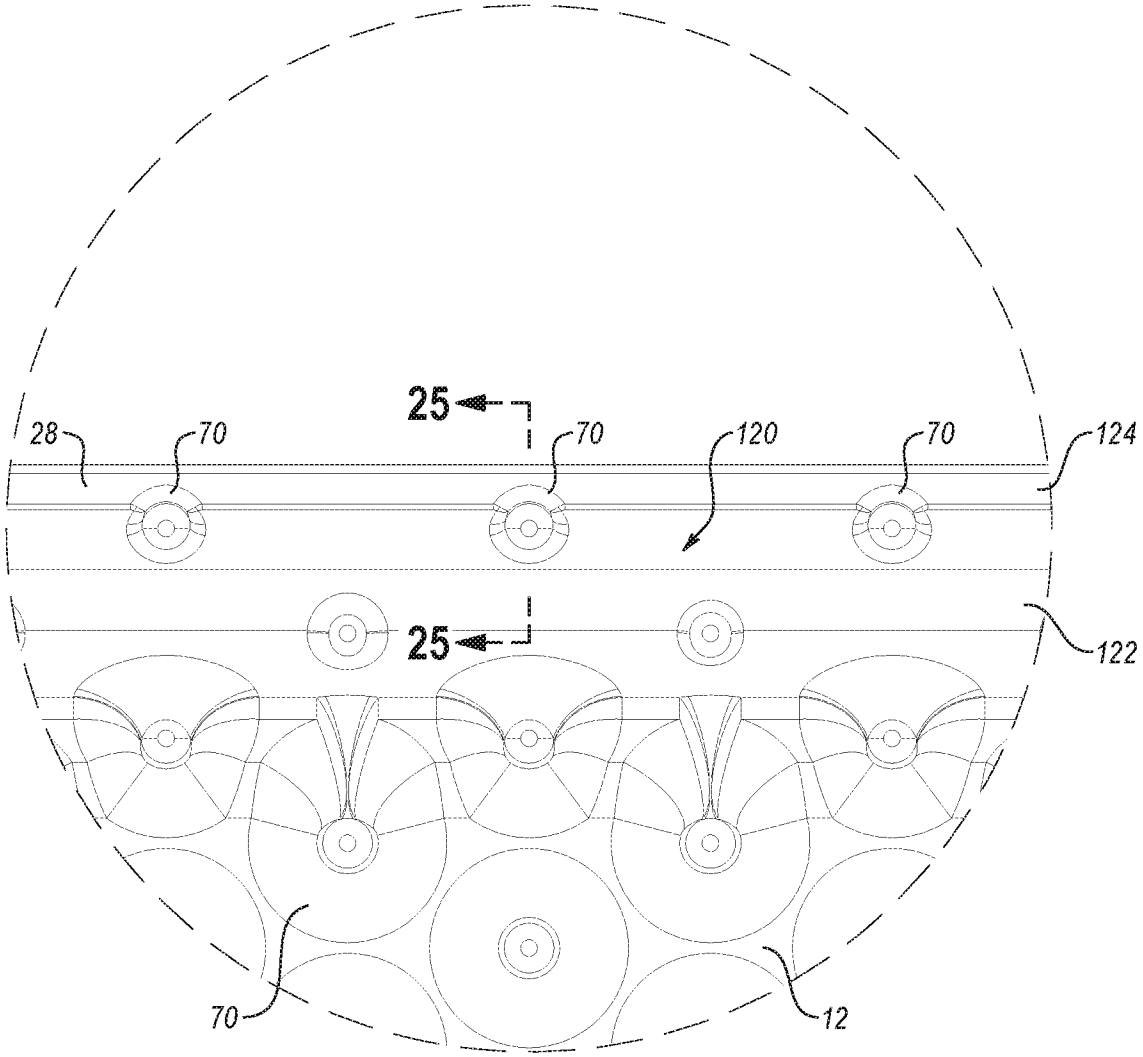
FIG. 23 is an enlarged bottom view of a portion of the table top shown in FIG. 6, identified by a broken line and the number 23 in FIG. 6.

In greater detail, as shown in FIGS. 6 and 23, the frame receiving portion 120 may be disposed along a side or edge of the table top 12, such as the first and second sides 14, 16 of the table top. The frame receiving portion 120 may be sized and configured to receive a portion of the frame 30, such as an upper portion of the frame. The frame receiving portion 120 may be at least partially formed or defined by the portion of the lip 28 that extends downwardly from the lower surface 24 of the table top 12. Thus, the lip 28 may form an edge or sidewall of the frame receiving portion 120. The lip 28 may also help protect the frame 30 from damage and the lip may facilitate attachment of the frame to the table top 12.

Figure 25:
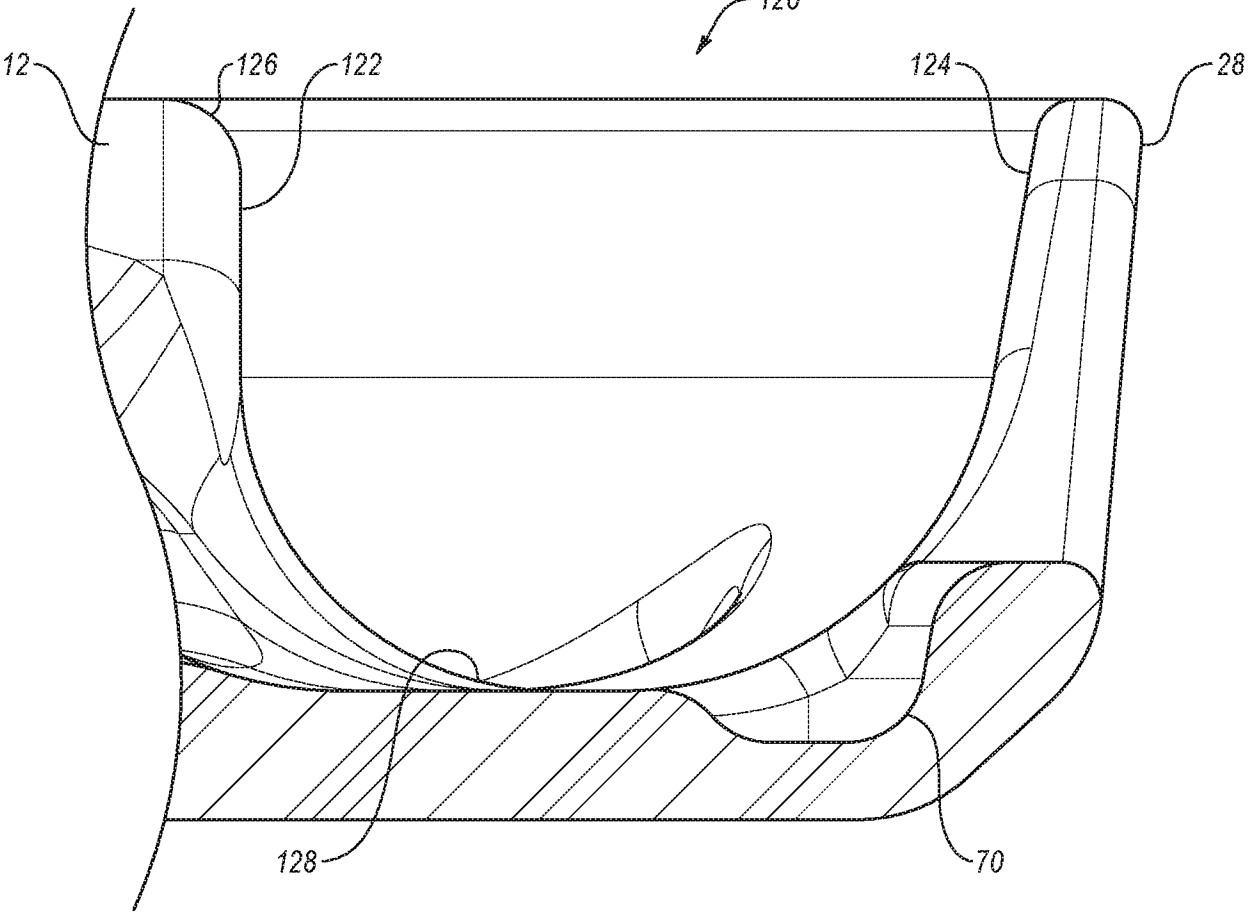
FIG. 25 is an enlarged cross-sectional side view of a portion of the table top shown by lines 25-25 in FIG. 23.

As shown in FIGS. 23 and 25, one or more depressions 70 may be disposed in the frame receiving portion 120 and the frame receiving portion may have a generally U-shaped configuration with a first sidewall 122, a second sidewall 124, a first portion 126, and a second portion 128. The frame receiving portion 120 may have a height between about 0.40 inches and about 0.60 inches, such as about 0.50 inches, and a width between about 0.40 inches and about 0.60 inches, such as about 0.50 inches. The thickness of the plastic in the second portion 128 of the frame receiving portion 120 may be between about 0.20 and 0.04 inches. After reviewing this disclosure, one skilled in the art will appreciate that the frame receiving portion 120 may have other suitable shapes, sizes, configurations and arrangements depending, for example, upon the type of frame 30 or intended use of the table 10.

Figure 24:
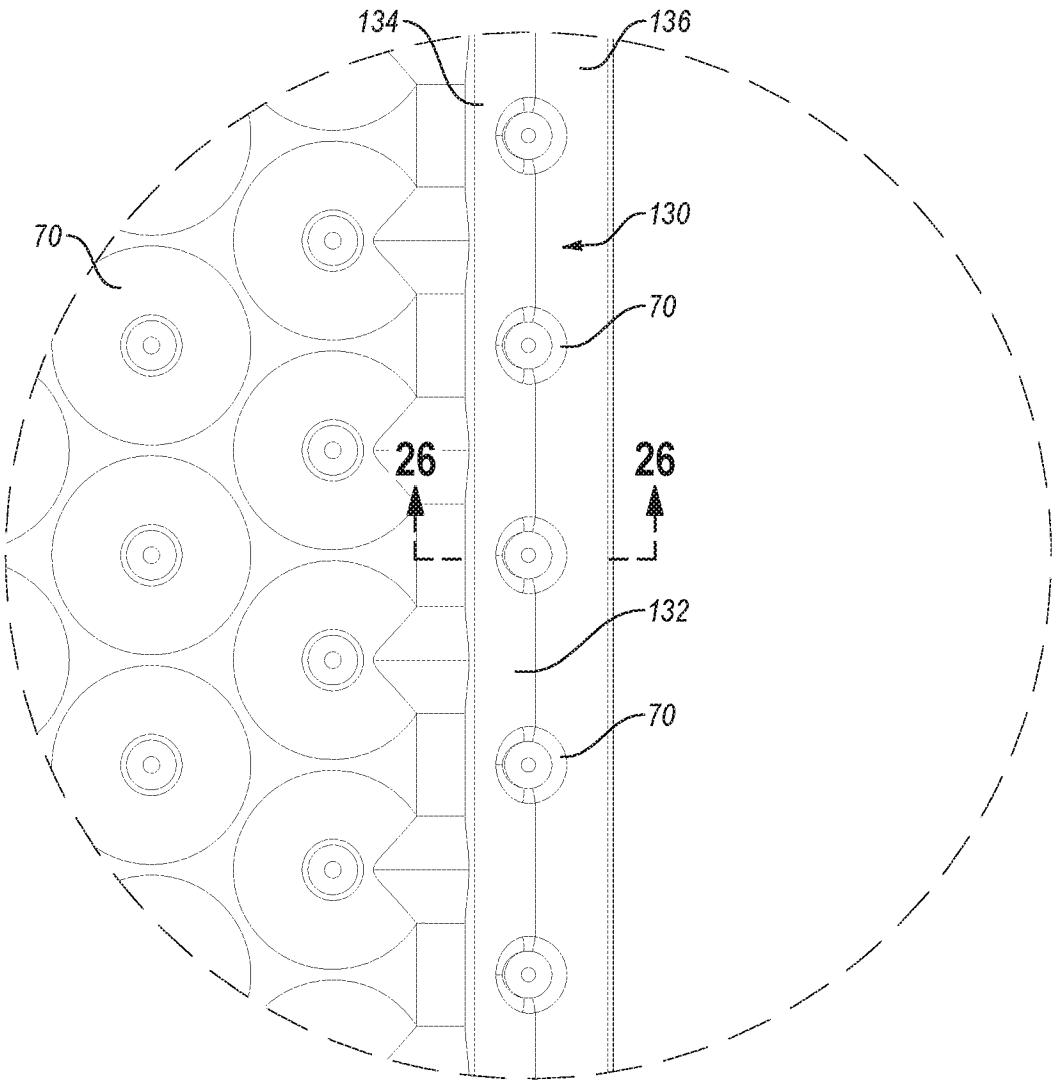
FIG. 24 is an enlarged bottom view of a portion of the table top shown in FIG. 6, identified by a broken line and the number 24 in FIG. 6.
Figure 26:
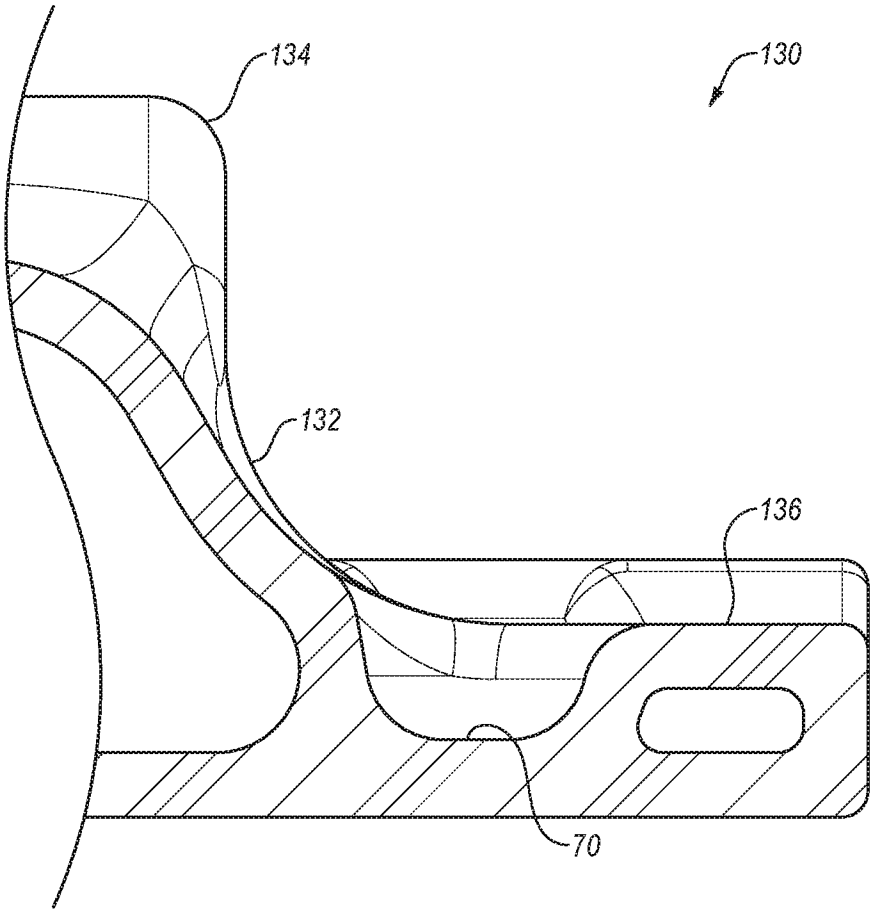
FIG. 26 is an enlarged cross-sectional side view of a portion of the table top shown by lines 26-26 in FIG. 24.

The table top 12 may also include a cross bar receiving portion 130 that is sized and configured to receive the cross bar 54. For example, as seen in FIGS. 6, 24, and 26, the cross bar receiving portion 130 may have a curved engagement surface 132 with a first portion 134 and a second portion 136. If desired, the engagement surface 132 of the cross bar receiving portion 130 may correspond to the size and shape of the cross bar 54. The cross bar receiving portion 130 may include one or more depressions 70 and, for a fold-in-half table, one portion of the cross bar receiving portion may be disposed in a first section of the table top 12 and another portion of the cross bar receiving portion may be disposed in a second section of the table top. The cross bar receiving portion 130 may have a height between about 0.30 inches and about 0.50 inches, such as about 0.40 inches, and a thickness of the plastic in the second portion 136 of the cross bar receiving portion 130 may be between about 0.20 and 0.04 inches.

Figure 27:
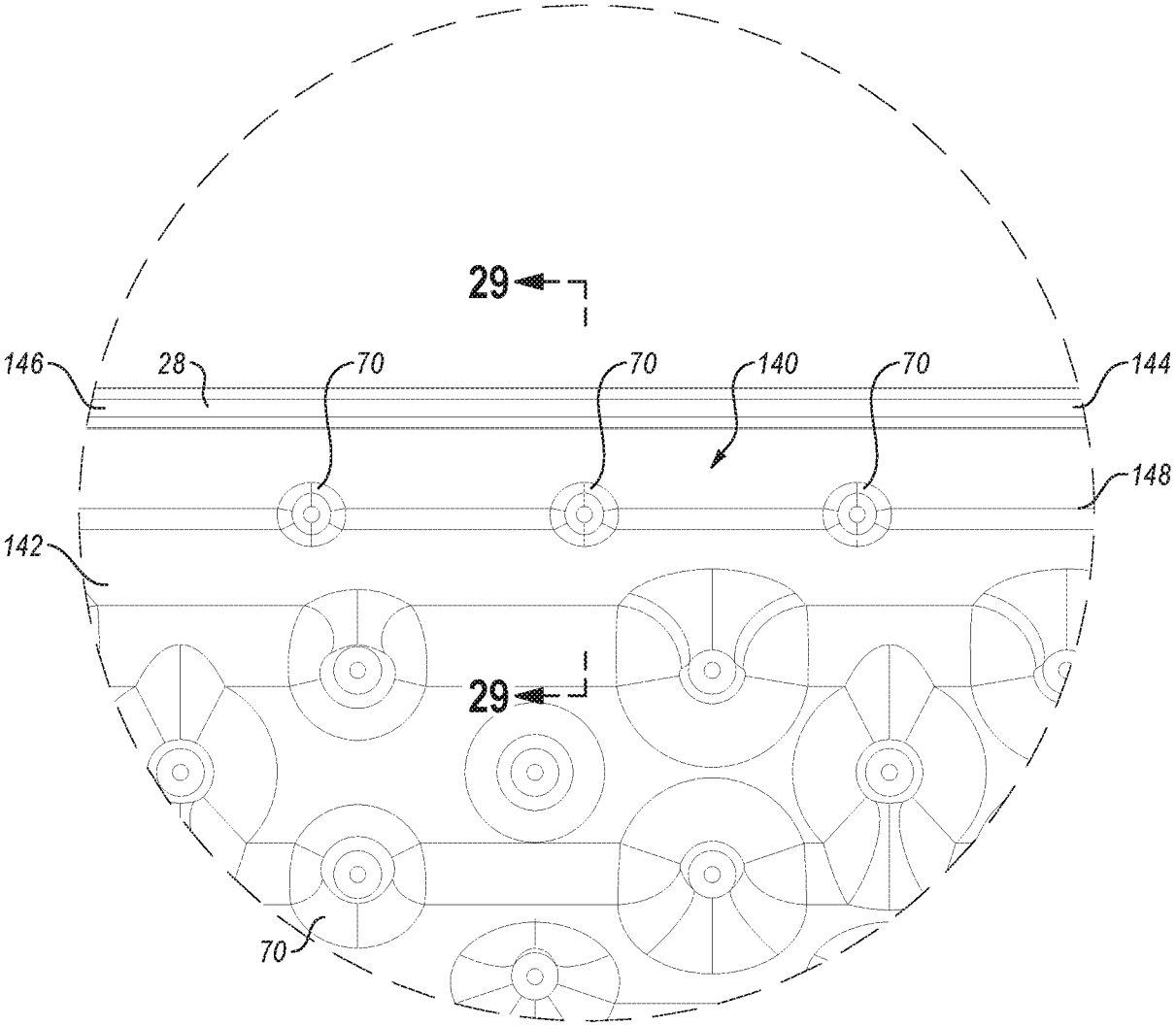
FIG. 27 is an enlarged bottom view of a portion of the table top shown in FIG. 19, identified by a broken line and the number 27 in FIG. 19.
Figure 29:
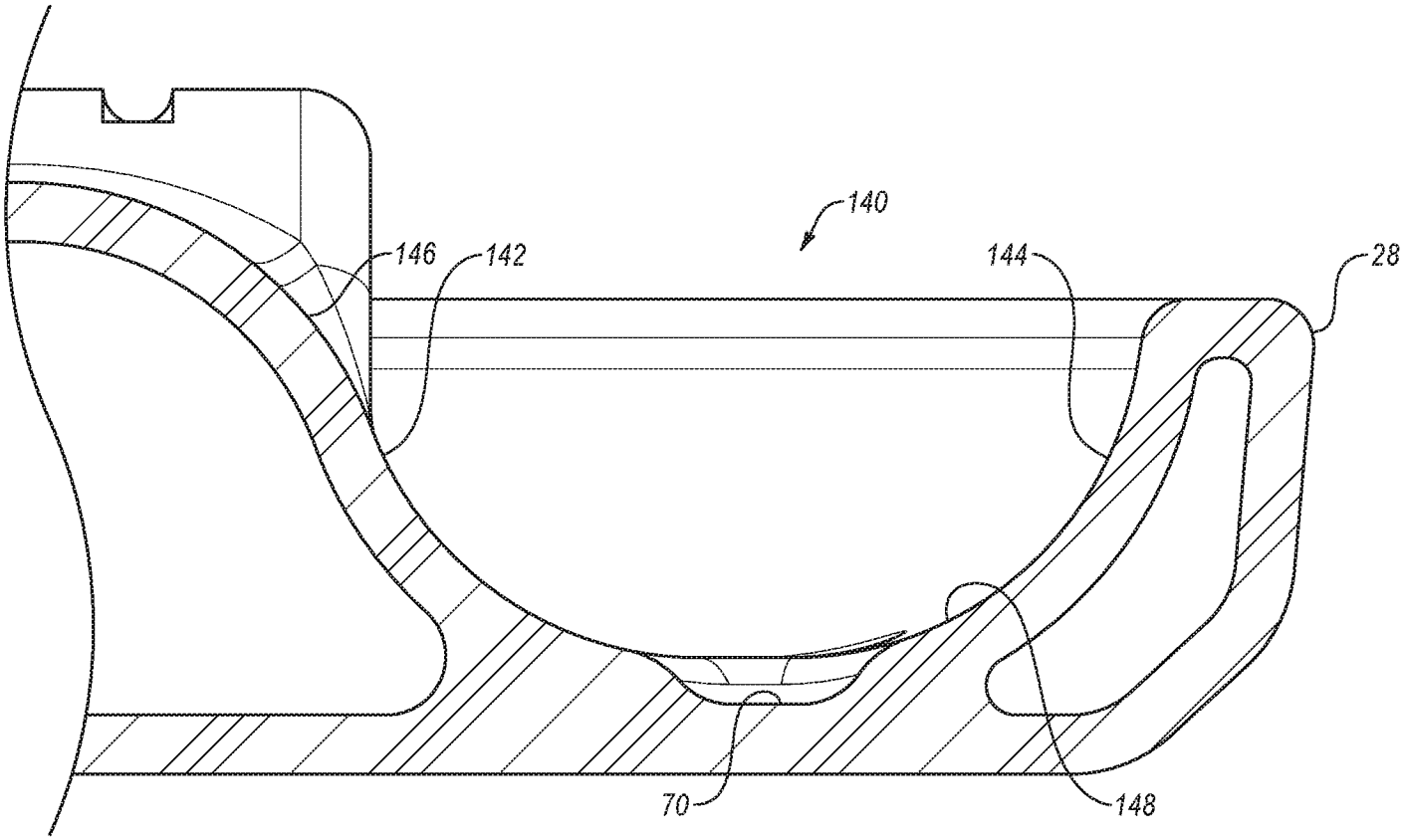
FIG. 29 is an enlarged cross-sectional side view of a portion of the table top shown by lines 29-29 in FIG. 27.

Another exemplary embodiment of a frame receiving portion 140 is shown in FIGS. 19, 27, and 29. The frame receiving portion 140 may include one or more depressions 70 and the frame receiving portion may be disposed adjacent and/or be formed or defined by a portion of the lip 28. As seen in FIG. 29, the frame receiving portion 140 may have a generally U-shaped configuration with a first sidewall 142, a second sidewall 144, a first portion 146, and a second portion 148. The frame receiving portion 140 may have a height between about 0.40 inches and about 0.60 inches, such as about 0.50 inches, and a width between about 0.60 inches and about 0.80 inches, such as about 0.70 inches. The thickness of the plastic in the second portion 148 of the frame receiving portion 140 may be between about 0.20 and 0.04 inches. The second sidewall 144 may be at least partially defined by the lip 28 and the lip may have a between about 0.30 inches and about 50 inches, such as about 0.40 inches.

Figure 28:
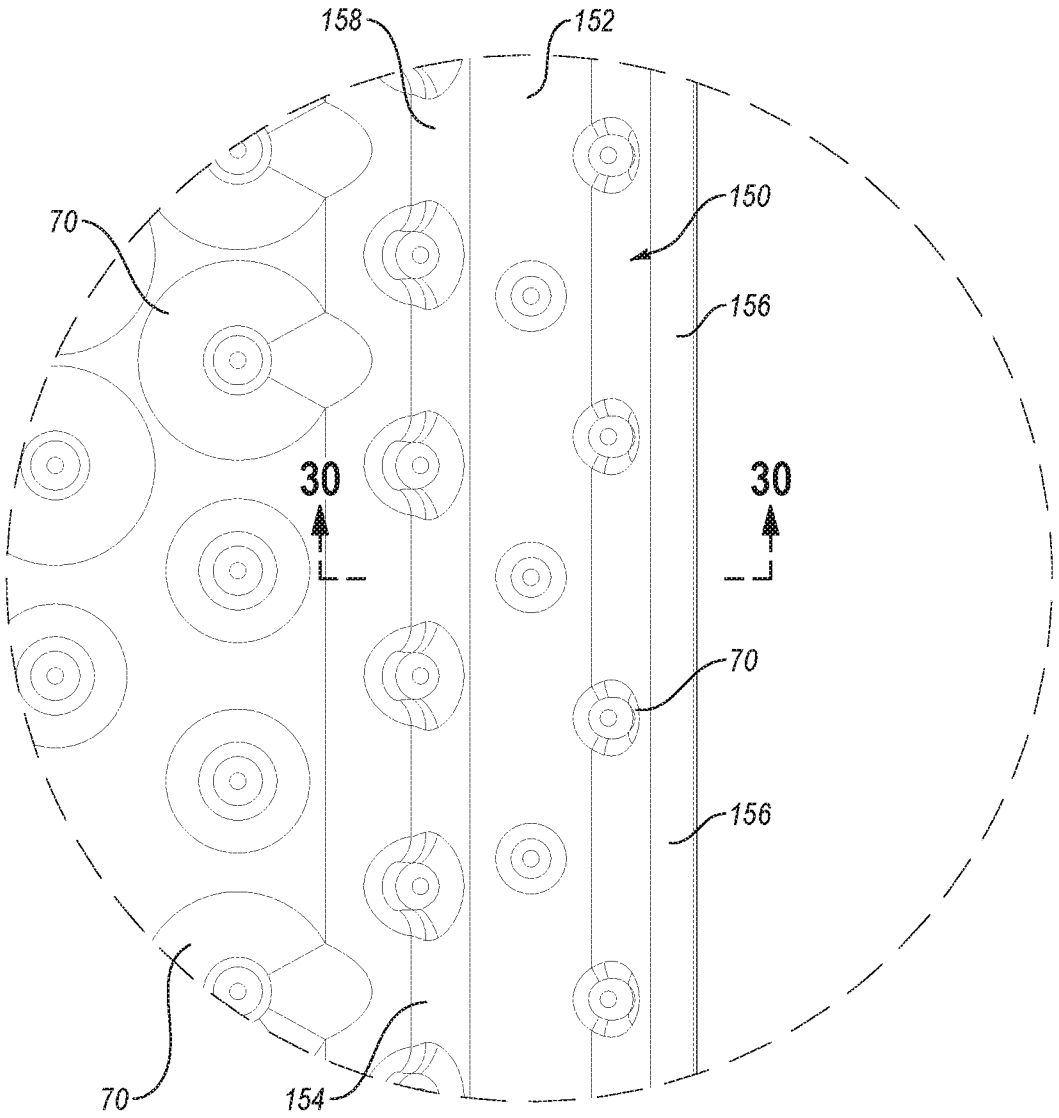
FIG. 28 is an enlarged bottom view of a portion of the table top shown in FIG. 19, identified by a broken line and the number 28 in FIG. 19.
Figure 30:
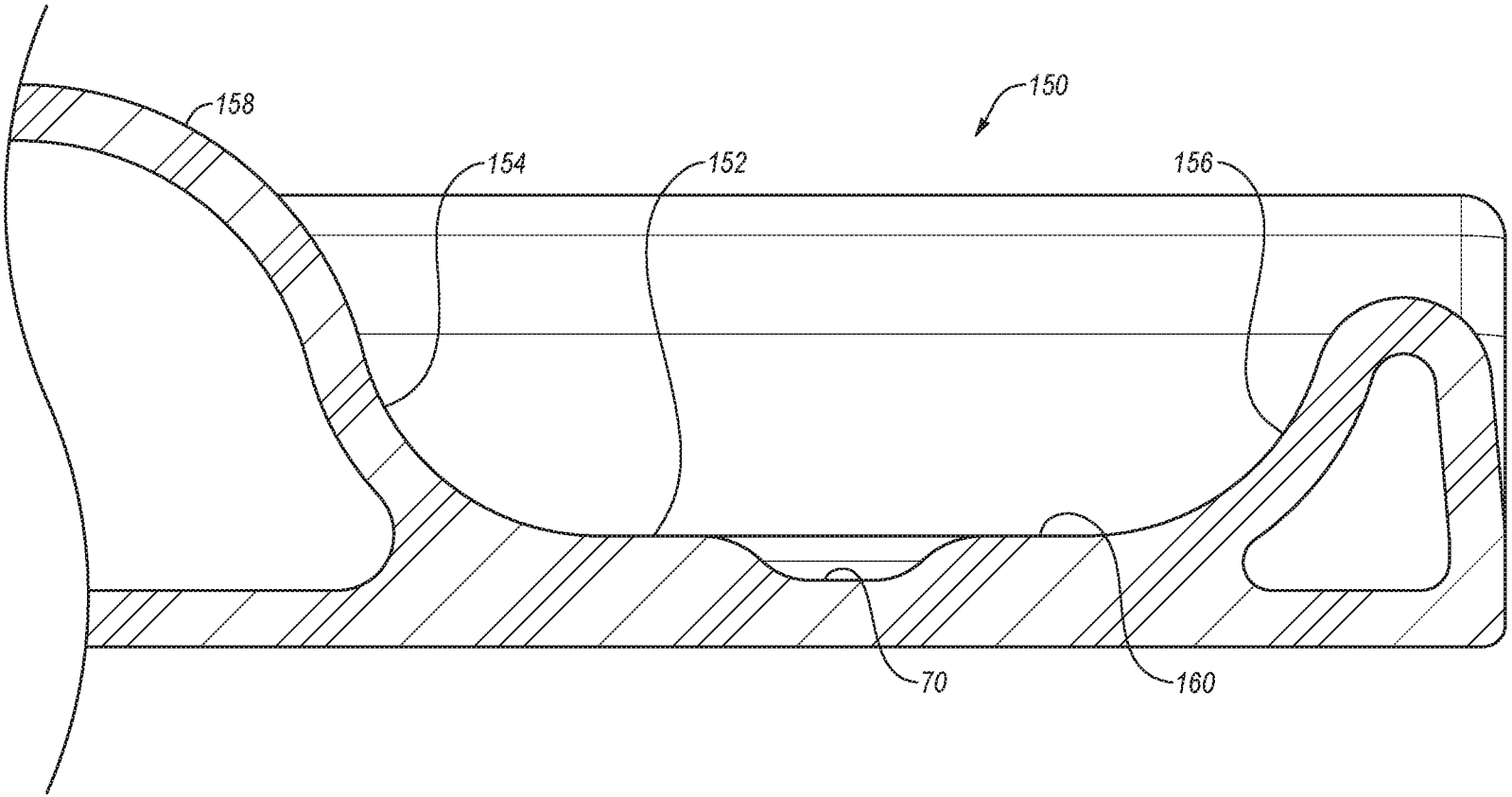
FIG. 30 is an enlarged cross-sectional side view of a portion of the table top shown by lines 30-30 in FIG. 28.

Another exemplary embodiment of a cross bar receiving portion 150 is seen in FIGS. 19, 28, and 30. The cross bar receiving portion 150 may have a curved engagement surface 152 with a first sidewall 154 and a second sidewall 156. If desired, the engagement surface 152 of the cross bar receiving portion 150 may correspond to the size and shape of the cross bar 54. The cross bar receiving portion 150 may include one or more depressions 70 and, for a fold-in-half table, one portion of the cross bar receiving portion may be disposed in a first section of the table top 12 and another portion of the cross bar receiving portion may be disposed in a second section of the table top. The cross bar receiving portion 150 may include a first portion 158 and a second portion 160. The cross bar receiving portion 150 may have a height between about 0.30 inches and about 0.50 inches, such as about 0.40 inches, and a thickness of the plastic in the second portion 160 of the cross bar receiving portion may be between about 0.20 and 0.04 inches. One skilled in the art will appreciated, after reviewing this disclosure, that the cross bar receiving portions 130, 150 may have other suitable shapes, sizes, configurations, and arrangements depending, for example, upon the type of table 10, cross bar 54, and the like.

As discussed above, previous large, generally planar blow-molded plastic structures required the opposing surfaces to be spaced apart by significantly more than one-half inch. The foregoing description, however, provides for the surprising and unexpected result that large, thin, generally planar blow-molded plastic structures may have a thickness generally equal to or less than one-half inch.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A panel constructed from blow-molded plastic, the blow-molded plastic panel comprising:

a first outer surface having a generally planar configuration;

a second outer surface generally spaced apart from the first surface;

a hollow interior portion at least partially disposed between the first surface and the second surface;

a plurality of depressions integrally formed in the second surface and extending towards the first surface, the first surface, the second surface, the hollow interior portion, and the plurality of depressions being integrally formed during the blow-molding process as part of a unitary, one-piece structure; and a section of the panel having a size of at least four (4) square feet, the section of the panel comprising:

a nominal panel thickness (PT) measured between the first surface and the second surface, the nominal panel thickness (PT) being equal to or less than 0.5 inches;

a nominal wall thickness (WT) of the first surface and the second surface, the nominal wall thickness (WT) being equal to or less than 0.05 inches;

a nominal distance (D) separating adjacent depressions of the plurality of depressions, the nominal distance (D) being equal to or less than 1.2 inches.

2. The blow-molded plastic panel as in claim 1, wherein the nominal panel thickness (PT) is equal to or less than 0.435 inches.

3. The blow-molded plastic panel as in claim 1, wherein the nominal panel thickness (PT) is equal to or less than 0.3 inches.

4. The blow-molded plastic panel as in claim 1, wherein the nominal panel thickness (PT) is equal to or less than 0.25 inches.

5. The blow-molded plastic panel as in claim 1, wherein the nominal panel thickness (PT) is equal to or less than 0.2 inches.

6. The blow-molded plastic panel as in claim 1, wherein the nominal panel thickness (PT) is equal to or less than 0.15 inches.

7. The blow-molded plastic panel as in claim 1, wherein the nominal panel thickness (PT) is equal to or less than 0.1 inches.

8. The blow-molded plastic panel as in claim 1, wherein the panel forms a tabletop for a table.

9. The blow-molded plastic panel as in claim 1, wherein the nominal wall thickness (WT) is equal to or less than 0.04 inches.

10. The blow-molded plastic panel as in claim 1, wherein at least a majority of the depressions of the plurality of depressions have an overall circular configuration.

11. The blow-molded plastic panel as in claim 1, wherein at least a majority of the depressions of the plurality of depressions have an overall uniform size, shape, and configuration;

wherein at least a majority of the depressions of the plurality of depressions arc uniformly spaced from adjacent depressions;

wherein the panel thickness (PT) is equal to or less than 0.45 inches;

wherein the wall thickness (WT) is equal to or less than 0.045 inches; and wherein the distance (D) is equal to or less than 0.75 inches.

12. The blow-molded plastic panel as in claim 1, wherein the nominal panel thickness (PT) is a mean distance between the upper surface and the lower surface;

wherein the nominal wall thickness (WT) is a mean wall thickness of the first surface and the second surface;

wherein the nominal distance (D) is a mean distance separating adjacent depressions of the plurality of depressions;

wherein the panel thickness (PT) is equal to or less than 0.45 inches;

wherein the wall thickness (WT) is equal to or less than 0.045 inches; and wherein the distance (D) is equal to or less than 0.75 inches.

13. The blow-molded plastic panel as in claim 1, wherein the nominal panel thickness (PT) is an average distance between the upper surface and the lower surface;

wherein the nominal wall thickness (WT) is an average wall thickness of the first surface and the second surface;

the nominal distance (D) is an average distance separating adjacent depressions of the plurality of depressions;

wherein at least a majority of the depressions of the plurality of depressions have an overall uniform size, shape, and configuration;

wherein at least a majority of the depressions of the plurality of depressions are overall uniformly spaced from adjacent depressions;

wherein the panel thickness (PT) is equal to or less than 0.45 inches;

wherein the wall thickness (WT) is equal to or less than 0.045 inches; and wherein the distance (D) is equal to or less than 0.75 inches.

14. The blow-molded plastic panel as in claim 1, wherein the panel thickness (PT) is equal to or less than 0.45 inches, the wall thickness (WT) is equal to or less than 0.045 inches, and the distance (D) is equal to or less than 0.75 inches.

15. The blow-molded plastic panel as in claim 1, wherein at least a majority of the depressions of the plurality of depressions are disposed in an overall uniform arrangement; and wherein the distance (D) is equal to or less than 0.75 inches.

16. The blow-molded plastic panel as in claim 1, wherein at least a majority of the depressions of the plurality of depressions are disposed in an overall uniform arrangement with each depression separated from an adjacent depression by an overall constant distance; and wherein the distance (D) is equal to or less than 0.75 inches.

17. The blow-molded plastic panel as in claim 1, wherein at least a majority of the depressions of the plurality of depressions include depressions with an overall uniform configuration and overall uniform characteristics disposed in an overall uniform pattern that covers a majority of the entire second surface to form a structure with overall uniform strength and structural integrity; and wherein the distance (D) is equal to or less than 0.75 inches.

18. The blow-molded plastic panel as in claim 1, wherein each depression in the plurality of depressions has an overall uniform configuration and is separated from an adjacent depression by an overall constant distance;

wherein the plurality of depressions covers at least a majority of the entire second surface to form a structure with overall uniform strength and structural integrity; and wherein the distance (D) is equal to or less than 0.5 inches.

19. The blow-molded plastic panel as in claim 1, wherein the first surface forms at least a portion of an upper surface of a tabletop; and wherein the distance (D) is equal to or less than 0.75 inches.

20. The blow-molded plastic panel as in claim 1, wherein the depressions in the plurality of depressions are sized and configured to help support the first surface in an overall consistent manner so that the first surface has overall uniform characteristics; and wherein the distance (D) is equal to or less than 0.5 inches.

21. The blow-molded plastic panel as in claim 1, wherein the panel comprises at least a portion of a tabletop;

wherein the upper surface comprises at least a portion of an upper surface of the tabletop and the lower surface comprises at least a portion of a lower surface of the tabletop;

wherein a frame is connected to the lower surface of the tabletop; and wherein an upper surface of the frame is disposed within about 0.25 inches or less of the upper surface of the tabletop.

22. The blow-molded plastic panel as in claim 21, further comprising one or more depressions disposed between the upper surface of the frame and the upper surface of the tabletop.

23. The blow-molded plastic panel as in claim 21, further comprising a frame receiving portion disposed in the lower surface and at least a portion of the frame disposed within the frame receiving portion.

24. The blow-molded plastic panel as in claim 21, wherein the upper surface of the frame is disposed within about 0.2 inches or less of the upper surface of the tabletop.

25. The blow-molded plastic panel as in claim 21, wherein the upper surface of the frame is disposed within about 0.15 inches or less of the upper surface of the tabletop.

* * * * *